US010406657B2

(12) United States Patent
Marovets

(10) Patent No.: US 10,406,657 B2
(45) Date of Patent: Sep. 10, 2019

(54) TOOL AND FASTENER MARKING SYSTEM

(71) Applicant: Jack L. Marovets, Cedar Rapids, IA (US)

(72) Inventor: Jack L. Marovets, Cedar Rapids, IA (US)

( * ) Notice: Subject to any disclaimer, the term of this patent is extended or adjusted under 35 U.S.C. 154(b) by 15 days.

(21) Appl. No.: 15/476,215

(22) Filed: Mar. 31, 2017

(65) Prior Publication Data

US 2017/0252903 A1 Sep. 7, 2017

Related U.S. Application Data

(63) Continuation of application No. 12/927,413, filed on Nov. 12, 2010, now Pat. No. 9,616,553.

(60) Provisional application No. 61/396,979, filed on Jun. 4, 2010.

(51) Int. Cl.
*B25B 13/08* (2006.01)
*G09F 3/00* (2006.01)

(52) U.S. Cl.
CPC ..... *B25B 13/08* (2013.01); *G09F 3/00* (2013.01); *Y10T 29/49* (2015.01); *Y10T 29/54* (2015.01)

(58) Field of Classification Search
CPC . B25B 13/08; G09F 3/00; Y10T 29/49; Y10T 29/54
USPC ..... 281/2, 5; 283/70, 72, 74, 81; 81/DIG. 5, 81/119, 121.1; 206/372, 376, 459.5
See application file for complete search history.

(56) References Cited

U.S. PATENT DOCUMENTS

| | | | | |
|---|---|---|---|---|
| 1,811,660 | A | 6/1931 | Bausher | |
| 1,984,839 | A | 12/1934 | Leslie | |
| 2,161,163 | A | 6/1939 | Hedgpeth | |
| 2,680,315 | A | 6/1954 | Mchugh et al. | |
| 3,212,207 | A | 10/1965 | Searing | |
| 3,650,059 | A | 3/1972 | Johnson | |
| 4,603,993 | A | 8/1986 | Jung | |
| 4,841,653 | A | 6/1989 | Negley | |
| 4,936,170 | A | 6/1990 | Zumeta | |
| 4,982,627 | A | 1/1991 | Johnson | |
| 5,079,978 | A * | 1/1992 | Kupfer | B25B 13/56 206/376 |
| 5,181,439 | A | 1/1993 | Schwartz | |
| 5,330,230 | A * | 7/1994 | Craig | G09F 3/00 283/55 |
| 5,341,707 | A | 8/1994 | Bond | |

(Continued)

FOREIGN PATENT DOCUMENTS

| | | |
|---|---|---|
| DE | 3635008 | 4/1988 |
| EP | 1990614 A2 | 11/2008 |
| WO | 02089098 | 11/2002 |

OTHER PUBLICATIONS

Alloy Artifacts Exploring Ingenuity in Iron, "Craftsman Tools: Maker "V" and the Modern Era", http://home.comcast.net/_alloy-artifacts/craftsman-maker-v.html, printed from Internet on Sep. 21, 2011, 34 pages.

(Continued)

*Primary Examiner* — Justin V Lewis
(74) *Attorney, Agent, or Firm* — Goodhue, Coleman & Owens, P.C.

(57) ABSTRACT

The present invention is a comprehensive system, method, and apparatus for marking tools, and other related objects, to be able to quickly identify the nearest size tool, or other object, regardless of the standard a tool, or other object, is manufactured according to.

13 Claims, 35 Drawing Sheets

(56) References Cited

U.S. PATENT DOCUMENTS

| | | | | |
|---|---|---|---|---|
| 6,047,618 | A * | 4/2000 | Pieri | B25B 13/06 81/121.1 |
| 6,082,227 | A | 7/2000 | Vogel | |
| 6,257,098 | B1 | 7/2001 | Cirone | |
| 6,393,950 | B1 | 5/2002 | Crosser | |
| 6,434,838 | B1 | 8/2002 | Mai | |
| 6,792,831 | B2 | 9/2004 | Crosser | |
| 6,880,364 | B1 | 4/2005 | Vidolin et al. | |
| 6,912,937 | B2 | 7/2005 | Tuanmu | |
| 6,990,761 | B1 | 1/2006 | Cox | |
| D528,383 | S | 9/2006 | Albertson | |
| 7,418,893 | B2 | 9/2008 | Hu | |
| 2001/0001892 | A1 | 5/2001 | Hu | |
| 2002/0139224 | A1 | 10/2002 | Crosser | |
| 2004/0149089 | A1 | 8/2004 | Tuanmu | |
| 2004/0205989 | A1 | 10/2004 | Michaels | |
| 2004/0216566 | A1 | 11/2004 | Shih | |
| 2006/0016571 | A1 | 1/2006 | Silakoski | |
| 2006/0053984 | A1 | 3/2006 | Walsh | |
| 2008/0047400 | A1 | 2/2008 | Hu | |
| 2008/0196562 | A1 | 8/2008 | Elliston et al. | |
| 2008/0302216 | A1* | 12/2008 | Hu | B25B 13/06 81/121.1 |
| 2009/0294311 | A1 | 12/2009 | Caldwell | |
| 2010/0050477 | A1 | 3/2010 | Zeek | |
| 2010/0288084 | A1 | 11/2010 | Bullard et al. | |

OTHER PUBLICATIONS

Craftsman, "Craftsman 14mm Wrench, 6 pt. Combination", http://www.craftsman.com/shc/s/ProductDisplay?partNumber=0094287000P&storeId=10 . . . , printed from Internet on Sep. 21, 2011, 2 pages.

* cited by examiner

4mm
40

39
5/32

40 m

39

5mm
50

4mm
40

4mm
4.0

3.9
5/32

TOOL AND FASTENER MARKING SYSTEM

PRIORITY STATEMENT

This application is a continuation of application Ser. No. 12/927,413 filed on Nov. 12, 2010 which is entitled Tool and Fastener Marking System which claims priority to U.S. Provisional Application No. 61/396,979, filed on Jun. 4, 2010, both of which are hereby incorporated by reference in their entireties.

FIELD OF THE INVENTION

The present invention relates to a comprehensive system, method, and 15 apparatus for marking tools, and other objects, to be able to quickly identify the nearest size tool, or other object, regardless of the standard a tool, or other object, is manufactured according to.

BACKGROUND OF THE INVENTION

In today's world, there are two primary standards for fasteners and tools, SAE and metric. To a lesser degree the British Whitworth standard is still used. In our global economy, multi-national companies often manufacture cars, trucks, boats, construction equipment, agricultural equipment, machinery, etc, using both SAE and metric standard sized fasteners on the same machine or object. This situation forces users, mechanics, repair personnel, etc to own, or have access to both SAE and metric tool sets. When two standards are predominate, such as SAE and metric, and in mixed use, much time can be wasted searching for the right tool to loosen or tighten a fastener. There have been many patents filed that attempt to address identifying tools whether they are manufactured according to the SAE, metric, or other standard.

U.S. Pat. No. 4,982,627, to Ken A. Johnson, describes a convoluted color system for use in identifying SAE and metric tools. This invention is not a universal marking system. It is instead based on ten different colors being used in combination to more easily identify tools within a standard, not across standards. What is needed is a unified marking system for identifying tools across various size standards.

US Patent Application 2008/0196562, to Elliston, et al, describes a system for use in identifying nut driver tools. This invention is not a universal marking system, but rather provides for marking the side of the handle, or the shaft with the size of the nut driver tool. What is needed is a unified marking system for identifying tools across various size standards.

US Patent Application 2001/0050477, to Andrew M. Hiller, describes a convoluted multi-tiered color system for use in identifying SAE and metric tools. This invention is not a universal marking system and is based on ten different colors being used in combination to more easily identify tools within a standard, not across standards. What is needed is a unified marking system for identifying tools across various size standards.

U.S. Pat. No. 6,792,831, to Larry G. Crosser, describes a convoluted color system for use in identifying SAE and metric tools. This invention is not a universal marking system, it is based on ten different colors being used in combination to more easily identify tools within a standard, not across standards. What is needed is a unified marking system for identifying tools across various size standards.

U.S. Pat. No. 6,393,950, to, Larry G. Crosser, describes a convoluted color system for use in identifying SAE and metric tools. This invention is not a universal marking system, but instead is based on ten different colors being used in combination to more easily identify tools within a standard, not across standards. What is needed is a unified marking system for identifying tools across various size standards.

U.S. Pat. No. 6,082,227, to Arthur C. Vogel, describes a convoluted color system for use in identifying SAE and metric tools. This invention is not a universal marking system and is based on ten different colors being used in combination to more easily identify 10 tools within a standard, not across standards. What is needed is a unified marking system for identifying tools across various size standards.

What is needed is a unified system, method, and apparatus that employs the use of sequential markings, or relative size markings in order to quickly determine the nearest size tool, or other object, regardless of the standard a tool, or other object, is manufactured to.

FEATURES AND OBJECTS OF THE PRESENT INVENTION

It is an object of the present invention to provide a unified system, method, and apparatus to solve the problem of identifying the relative size of a tool regardless of the standard it has been manufactured to.

It is an object of the present invention to provide a unified system, method, and apparatus to solve the problem of identifying the size of a tool with sequential marks regardless of the standard it has been manufactured to.

It is an object of the present invention to use a unified marking system that uses sequential numbers to identify tools in a combination SAE and metric set from smallest to largest.

It is an object of the present invention to use a unified marking system to mark open end wrenches.

It is an object of the present invention to use a unified marking system to mark box end wrenches.

It is an object of the present invention to use a unified marking system to mark combination open end-box end wrenches.

It is an object of the present invention to use a unified marking system to mark sockets.

It is an object of the present invention to use a unified marking system to mark fasteners.

It is an object of the present invention to use a unified marking system to mark fastener bins.

It is an object of the present invention to use a unified marking system to mark wrenches which include on one end an SAE standard tool, and on the other end a metric standard tool.

It is an object of the present invention to use a unified marking system to mark offset wrenches.

It is an object of the present invention to use a unified marking system to mark adjustable end wrenches to indicate the range of the jaws.

It is an object of the present invention to use a unified marking system to mark pipe wrenches to indicate the range of the jaws.

It is an object of the present invention to use a unified marking system to mark monkey wrenches to indicate the range of the jaws.

It is an object of the present invention to use a unified marking system to mark ratcheting box wrenches.

It is an object of the present invention to use a unified marking system to mark 10 vise grips to indicate the range of the jaws.

It is an object of the present invention to use a unified marking system to mark nut drivers.

It is an object of the present invention to use a unified marking system to mark wrenches for use with internal sockets.

It is an object of the present invention to use a unified marking system to mark tools in conjunction with color to indicate whether a tool is SAE or metric.

It is an object of the present invention to use a unified marking system to mark tools in conjunction with a textured surface to indicate whether a tool is SAE or metric.

It is an object of the present invention to use a unified marking system to mark tools in conjunction with color, and a textured surface to indicate whether a tool is SAE or metric.

It is an object of the present invention to use a unified marking system that includes the letter "m" or "M" to mark tools that are metric.

It is an object of the present invention to embed or attached RFID tags to tools that are marked with the unified marking system.

It is an object of the present invention to embed or attached RFID tags to tools that are not marked with the unified marking system.

It is an object of the present invention to attach bar coded tags to tools that are marked with the unified marking system.

It is an object of the present invention to attach bar coded tags to tools that are not marked with the unified marking system.

It is an object of the present invention to use the EPC-global standard for identification for RFID tags or bar coded tags that are marked with the unified marking system.

It is an object of the present invention to mark a tool with the unified marking system during the manufacturing process.

It is an object of the present invention to mark a tool with the unified marking system after the manufacturing process with an engraving tool.

It is an object of the present invention to mark a tool with the unified marking system after the manufacturing process with a stamping tool.

It is an object of the present invention to mark a tool with the unified marking system after the manufacturing process with a laser.

It is an object of the present invention for the digital readout on a caliper to readout a measurement using the unified marking system of the present invention.

It is an object of the present invention to provide a linear measurement device that is graduated using the unified marking system of the present invention.

It is an object of the present invention to provide a linear measurement device that is graduated using the unified marking system of the present invention that is stamped or engraved into a tool.

It is an object of the present invention to provide a chart that includes SAE, metric, and the corresponding unified marking system sequential indicia.

It is an object of the present invention to provide a chart that includes SAE, metric, and the corresponding unified marking system relative size marking.

It is an object of the present invention to provide sequential markings that are numbers.

It is an object of the present invention to provide sequential markings that are letters.

It is an object of the present invention to provide relative size markings that are numbers.

It is an object of the present invention to provide relative size markings that are letters.

BRIEF SUMMARY OF THE INVENTION

The preset invention overcomes the short comings of the prior art by providing a new and improved, unified method for marking fasteners and tools, such as, but not limited to open end wrenches, box end wrenches, combination wrenches, wrenches with a socket on one end, sockets, etc. The present invention for marking tools, allows a user to quickly determine the size of tools in mixed sets, which are manufactured according to more than one standard, such as, but not limited to, SAE, metric, Whitworth, etc.

In the primary embodiment of the present invention, a unified marking system for tool sets that include tools manufactured according to the SAE and metric standards, which are further identified using the present invention to sequentially number a combined SAE-metric tool set to indicate the sequential size of each wrench end, socket, etc, from smallest to largest.

In the secondary embodiment of the present invention, a unified marking system for tool sets that include tools manufactured according to the SAE and metric standards, which are further identified using the present invention to mark a combined SAE-metric tool set to indicate the relative size of each wrench end, socket, etc, from smallest to largest.

In a third embodiment of the present invention, a unified marking system for tool sets that include tools manufactured according to the SAE and metric standards, which are further identified using the present invention to sequentially lettered a combined SAE-metric tool set to indicate the sequential size of each wrench end, socket, etc, from smallest to largest.

In yet another embodiment of the present invention, a unified marking system for tool sets that include tools manufactured according to the SAE, metric, and Whitworth standards, which are further identified using the present invention to mark a combined SAE-metric, Whitworth tool set to indicate the sequential size of each wrench end, socket, etc, from smallest to largest.

In yet another embodiment of the present invention, a unified marking system for tool sets that include tools manufactured according to the SAE, metric, and Whitworth standards, which are further identified using the present invention to mark a combined SAE-metric-Whitworth tool set to indicate the relative size of each wrench end, socket, etc, from smallest to largest.

The various embodiments of the present invention can be combined with one or more features to further enhance utility for a user, such as but not limited to, color, texture, etc.

In addition, the present invention's unified marking system can be applied to fasteners such as, but not limited to, screws, nuts, and bolts.

In view of the foregoing disadvantages inherent for tools manufactured according to different standards currently in use in the prior art, the present invention provides an improved unified marking system, which will be described subsequently in great detail, to provide a new and improved unified marking system for tools which is not anticipated, rendered obvious, suggested, or implied by the prior art, either alone or in any combination thereof.

There has thus been outlined, rather broadly, the more important features of the present invention in order that the detailed description thereof that follows may be better understood, and in order that the present contribution of the art may be better appreciated.

Numerous objects, features and advantages of the present invention will be readily apparent to those of ordinary skill in the art upon reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present invention will become more fully understood from the detailed description and the accompanying drawings, wherein.

DESCRIPTION OF EMBODIMENT

Figure 1A:
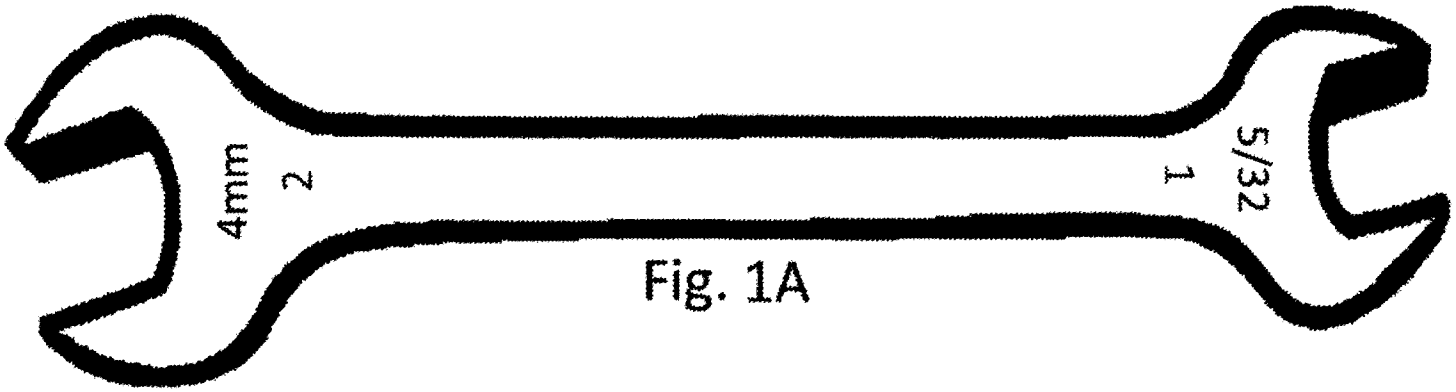
FIG. 1A is an illustration of one embodiment of the present invention.

The preset invention overcomes the shortcomings of the prior art by providing a new and improved, unified method for marking fasteners and tools, such as, but not limited to open end wrenches, box end wrenches, combination wrenches, wrenches with a socket on one end, sockets, etc. The present invention for marking tools, allows a user to quickly determine the size of tools in mixed sets, which are manufactured according to more than one standard, such as, but not limited 1a, SAE, metric, Whitworth, etc.

In the primary embodiment of the present invention, a unified marking system for tool sets that include tools manufactured according to the SAE and metric standards, which are further identified using the present invention, to sequentially number a combined SAE-metric tool set to indicate the sequential size of each wrench end, socket, etc, from smallest to largest.

In the secondary embodiment of the present invention, a unified marking system for tool sets that include tools manufactured according to the SAE and metric standards, which are further identified using the present invention to mark a combined SAE-metric tool set to indicate the relative size of each wrench end, socket, etc, from smallest to largest.

In a third embodiment of the present invention, a unified marking system for tool sets that include tools manufactured according to the SAE and metric standards, which are further identified using the present invention to sequentially letter a combined SAE-metric tool set to indicate the sequential size of each wrench end, socket, etc, from smallest to largest.

In yet another embodiment of the present invention, a unified marking system for tool sets that include tools manufactured according to the SAE, metric, and Whitworth standards, which are further identified using the present invention to mark a combined SAE-metric-Whitworth tool set to indicate the sequential size of each wrench end, socket, etc, from smallest to largest.

In yet another embodiment of the present invention, a unified marking system for tool sets that include tools manufactured according to the SAE, metric, and Whitworth standards, which are further identified using the present invention to mark a combined SAE-metric-Whitworth tool set to indicate the relative size of each wrench end, socket, etc, from smallest to largest.

The various embodiments of the present invention can be combined with one or more features to further enhance utility for a user, such as but not limited to. color, texture, etc.

In addition, the present invention's unified marking system can be applied to fasteners such as, but not limited to, screws, nuts, bolts The following patents, or patent applications, include a means for measurement that can be incorporated as a useful feature for use in conjunction with the present invention.

U.S. Pat. No. 7,013,763, to Chih-Ching Hseln, includes a means for measurement, and is hereby incorporated by reference.

US Patent Application 2010/0077553, James D. Davidson, includes a means for measurement, and is hereby incorporated by reference.

US Patent Application, 2007/0157484, to Michael J. Grubler, includes a means for measurement, and is hereby incorporated by reference.

US Patent Application 2007/0051211, Stewart et al, includes a means for measurement, and is hereby incorporated by reference.

Chart 1 illustrates one method of the present invention's unified marking system for SAE and metric standard tools. Chart 1 illustrates a sequential marking system that ranks SAE and metric tools from smallest to largest.

One method of using the unified marking system indicia in Chart 1 is illustrated in FIG. 1A for a combination SAE-metric standard double open end wrench.

Figure 1B:
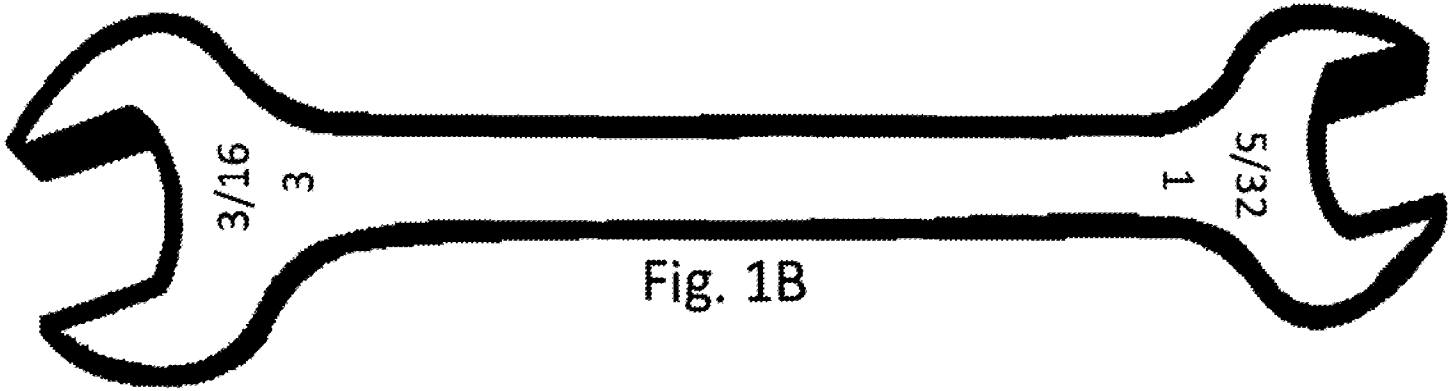
FIG. 1B is an illustration of one embodiment of the present invention.
Figure 1C:
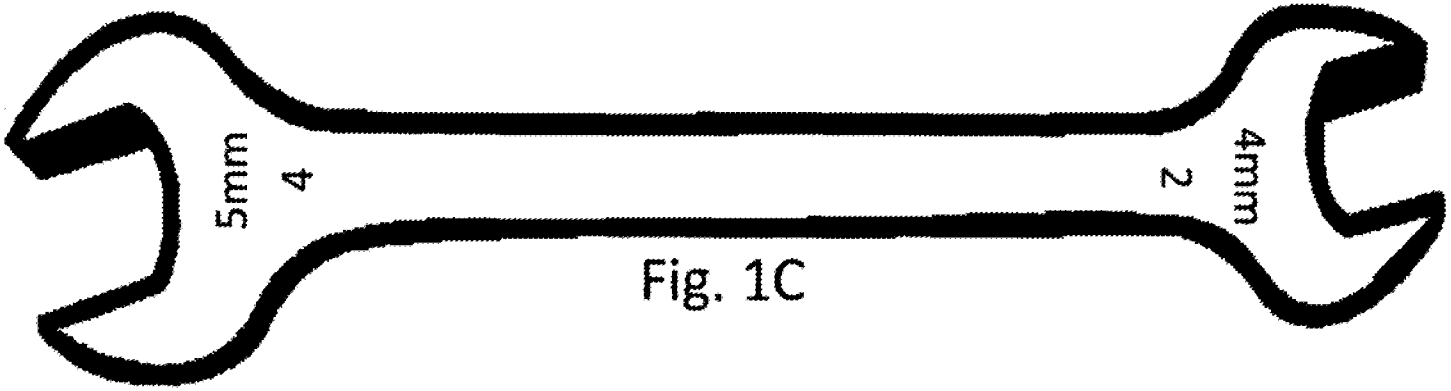
FIG. 1C is an illustration of one embodiment of the present invention.

FIGS. 1B and 1C illustrate the unified marking system indicia in Chart 1 for an SAE double open end wrench as illustrated in FIG. 1B, and for a metric standard double open end wrench as illustrated in FIG. 1C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 1

SEQUENTIAL MARKING FOR COMBINATION SAE-METRIC WRENCH OR SOCKET SETS

| SAE (Distance Across Flats) (inches) | METRIC (Distance Across Flats) (mm) | PRESESNT INVENTION (Sequential Marking) |
|---|---|---|
| 5/32 | | 1 |
| | 4 | 2 |
| 3/16 | | 3 |
| | 5 | 4 |
| 7/32 | | 5 |
| | 6 | 6 |
| 1/4 | | 7 |
| | 7 | 8 |
| 9/32 | | 9 |
| 5/16 | | 10 |
| | 8 | 11 |
| | 9 | 12 |
| 3/8 | | 13 |
| | 10 | 14 |
| | 11 | 15 |
| 7/16 | | 16 |
| | 12 | 17 |
| 1/2 | | 18 |
| | 13 | 19 |
| | 14 | 21 |
| 9/16 | | 22 |
| | 15 | 23 |
| 5/8 | | 24 |
| | 16 | 25 |
| | 17 | 26 |
| 11/16 | | 27 |
| | 18 | 28 |
| | 19 | 29 |
| 3/4 | | 30 |
| | 20 | 31 |
| 13/16 | | 32 |
| | 21 | 33 |
| | 22 | 34 |
| 7/8 | | 35 |
| | 23 | 36 |
| 15/16 | | 37 |
| | 24 | 38 |
| | 25 | 39 |
| 1 | | 40 |
| | 26 | 41 |

Chart 2 illustrates one method of the present invention's unified marking system for SAE and metric standard tools.

Chart 2 illustrates a sequential marking system that ranks SAE and metric tools from smallest to largest. Chart 2 also includes a letter "m" added to the sequential indicia to indicate whether the tool is sized for the metric system.

Figure 2A:
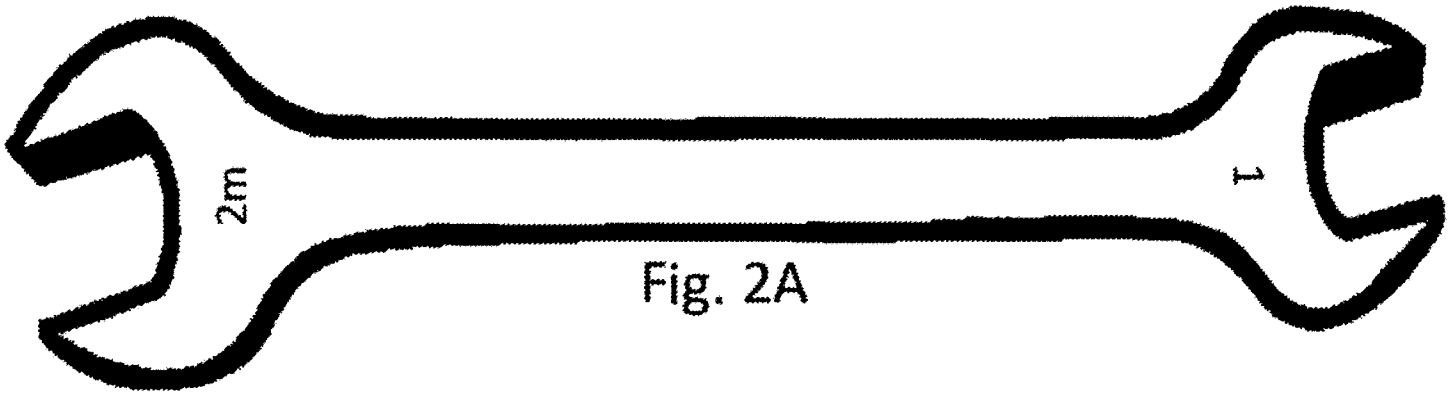
FIG. 2A is an illustration of one embodiment of the present invention.

One method of using the unified marking system indicia in Chart 2 is illustrated in FIG. 2A for a combination SAE-metric standard double open end wrench.

Figure 2B:
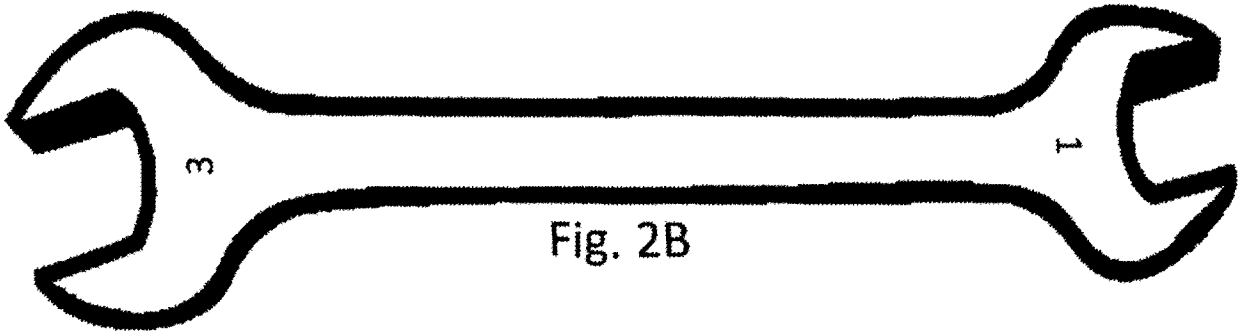
FIG. 2B is an illustration of one embodiment of the present invention.
Figure 2C:
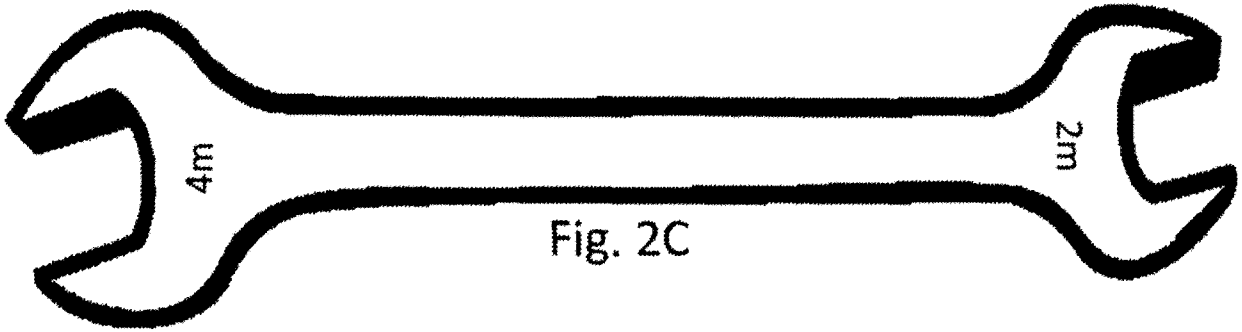
FIG. 2C is an illustration of one embodiment of the present invention.

FIGS. 2B and 2C illustrate the unified marking system indicia in Chart 2 for an SAE double open end wrench as illustrated in FIG. 2B, and for a metric standard double open end wrench as illustrated in FIG. 2C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 2

SEQUENTIAL MARKING FOR COMBINATION SAE-METRIC WRENCH OR SOCKET SETS

| SAE (Distance Across Flats) (inches) | METRIC (Distance Across Flats) (mm) | PRESENT INVENTION (Alternative Sequential Marking Where "m" indicates Metric) |
|---|---|---|
| 5/32 | | 1 |
| | 4 | 2 m |
| 3/16 | | 3 |
| | 5 | 4 m |
| 7/32 | | 5 |
| | 6 | 6 m |
| 1/4 | | 7 |
| | 7 | 8 m |
| 9/32 | | 9 |
| 5/16 | | 10 |
| | 8 | 11 m |
| | 9 | 12 m |
| 3/8 | | 13 |
| | 10 | 14 m |
| | 11 | 15 m |
| 7/16 | | 16 |
| | 12 | 17 m |
| 1/2 | | 18 |
| | 13 | 19 m |
| | 14 | 21 m |
| 9/16 | | 22 |
| | 15 | 23 m |
| 5/8 | | 24 |
| | 16 | 25 m |
| | 17 | 26 m |
| 11/16 | | 27 |
| | 18 | 28 m |
| | 19 | 29 m |
| 3/4 | | 30 |
| | 20 | 31 m |
| 13/16 | | 32 |
| | 21 | 33 m |
| | 22 | 34 m |
| 7/8 | | 35 |
| | 23 | 36 m |
| 15/16 | | 37 |
| | 24 | 38 m |
| | 25 | 39 m |
| 1 | | 40 |
| | 26 | 41 m |

Chart 3 illustrates one method of the present invention's unified marking system for SAE and metric standard tools. Chart 3 illustrates a sequential marking system that ranks SAE and metric tools from smallest to largest. Chart 3 also includes a two color code to indicate whether the tool is sized for the SAE or metric system. As an example in FIGS. 3B and 3C, the color green indicates the tool is sized for SAE, and the color red indicates the tool is sized for metric.

Figure 3A:
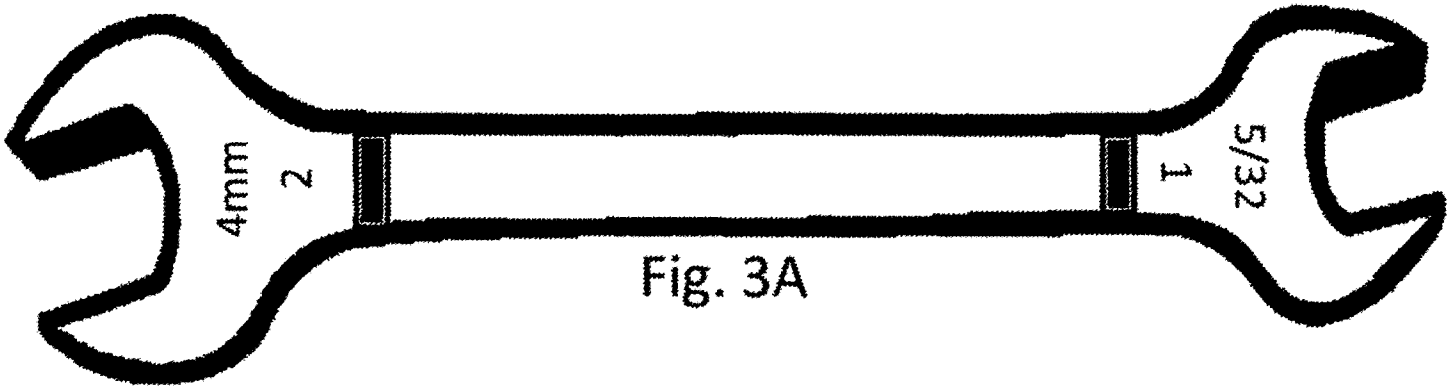
FIG. 3A is an illustration of one embodiment of the present invention.

One method of using the unified marking system indicia in Chart 3 is illustrated in FIG. 3A for a combination SAE-metric standard double open end wrench.

Figure 3B:
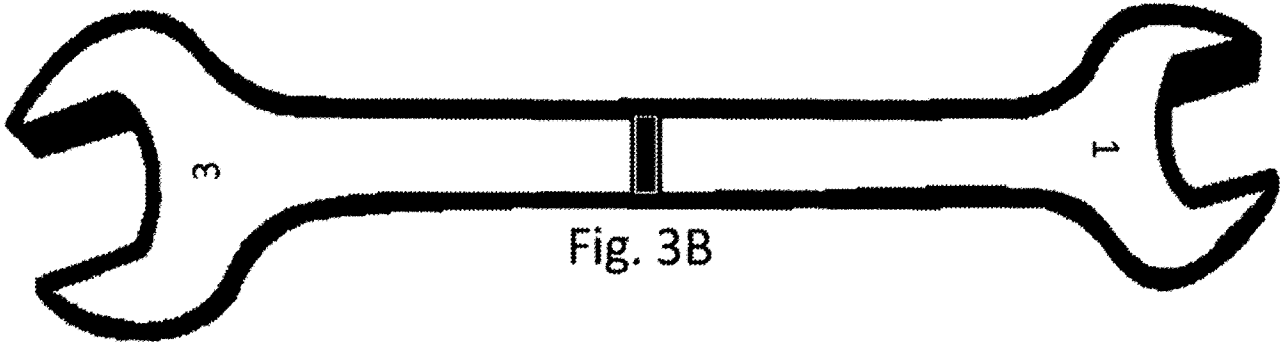
FIG. 3B is an illustration of one embodiment of the present invention.
Figure 3C:
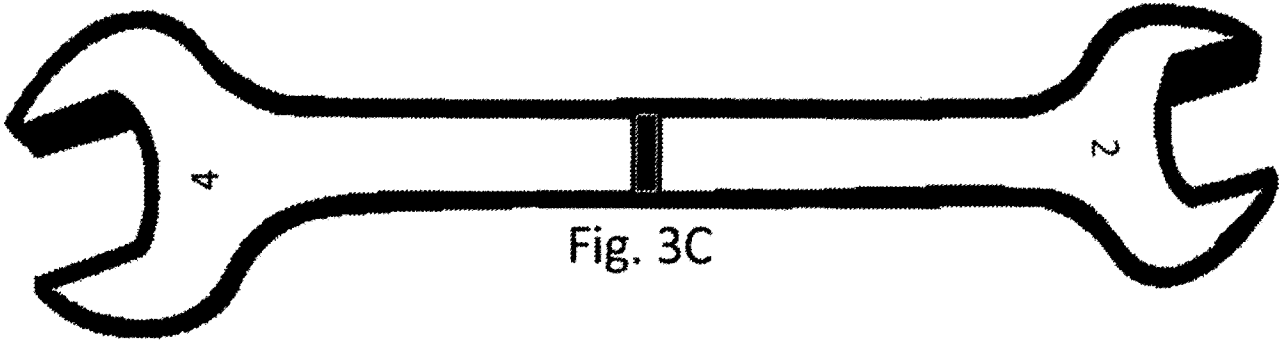
FIG. 3C is an illustration of one embodiment of the present invention.

FIGS. 3B and 3C illustrate the unified marking system indicia in Chart 3 for an SAE double open end wrench as illustrated in FIG. 3B, and for a metric standard double open end wrench as illustrated in FIG. 3C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 3

SEQUENTIAL MARKING FOR COMBINATION SAE-METRIC WRENCH OR SOCKET SETS

| SAE (Distance Across Flats) (inches) | METRIC (Distance Across Flats) (mm) | PRESESNT INVENTION (Sequential Marking) | PRESESNT INVENTION (Wrench Color Marking) |
|---|---|---|---|
| 5/32 | | 1 | Color A |
| | 4 | 2 | Color B |
| 3/16 | | 3 | Color A |
| | 5 | 4 | Color B |
| 7/32 | | 5 | Color A |
| | 6 | 6 | Color B |
| 1/4 | | 7 | Color A |
| | 7 | 8 | Color B |
| 9/32 | | 9 | Color A |
| 5/16 | | 10 | Color A |
| | 8 | 11 | Color B |
| | 9 | 12 | Color B |
| 3/8 | | 13 | Color A |
| | 10 | 14 | Color B |
| | 11 | 15 | Color B |
| 7/16 | | 16 | Color A |
| | 12 | 17 | Color B |
| 1/2 | | 18 | Color A |
| | 13 | 19 | Color B |
| | 14 | 21 | Color B |
| 9/16 | | 22 | Color A |
| | 15 | 23 | Color B |
| 5/8 | | 24 | Color A |
| | 16 | 25 | Color B |
| | 17 | 26 | Color B |
| 11/16 | | 27 | Color A |
| | 18 | 28 | Color B |
| | 19 | 29 | Color B |
| 3/4 | | 30 | Color A |
| | 20 | 31 | Color B |
| 13/16 | | 32 | Color A |
| | 21 | 33 | Color B |
| | 22 | 34 | Color B |
| 7/8 | | 35 | Color A |
| | 23 | 36 | Color B |
| 15/16 | | 37 | Color A |
| | 24 | 38 | Color B |
| | 25 | 39 | Color B |
| 1 | | 40 | Color A |
| | 26 | 41 | Color B |

Chart 4 illustrates one method of the present invention's unified marking system for SAE and metric standard tools. Chart 4 illustrates a sequential marking system that ranks SAE and metric tools from smallest to largest. Chart 4 also includes a two color code to indicate whether the tool is sized for the SAE or metric system. As an example in FIG. 4B the color green indicates the tool is sized for SAE, and FIG. 4C the color red indicates the tool is sized for metric. Chart 4 also includes a letter "m" added to the sequential indicia to further indicate whether the tool is sized for the metric system.

Figure 4A:
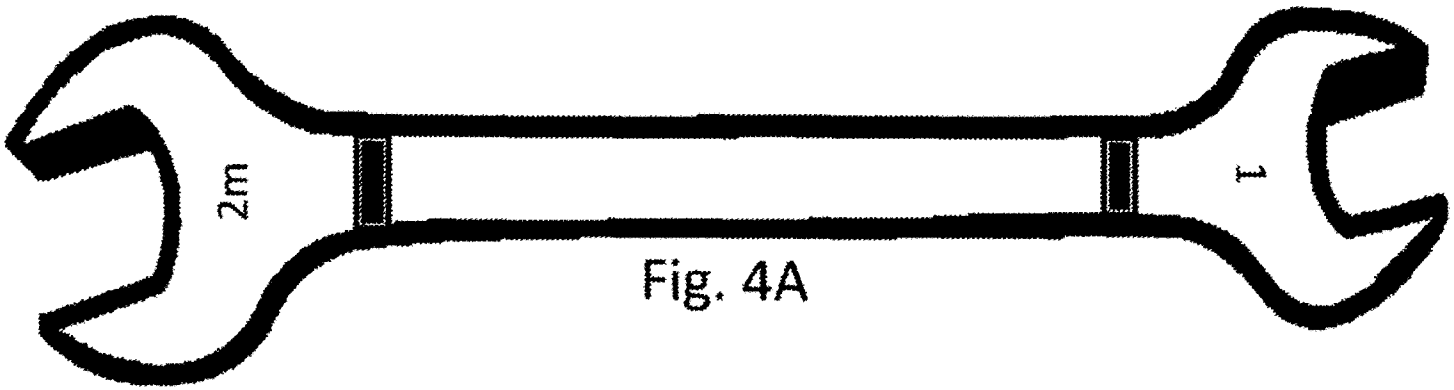
FIG. 4A is an illustration of one embodiment of the present invention.

One method of using the unified marking system indicia in Chart 4 is illustrated in FIG. 4A for a combination SAE-metric standard double open end wrench.

Figure 4B:
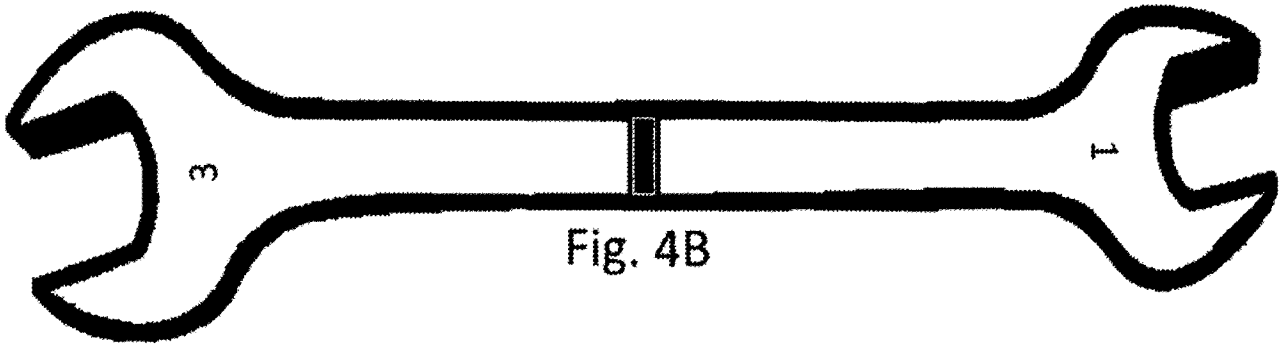
FIG. 4B is an illustration of one embodiment of the present invention.
Figure 4C:
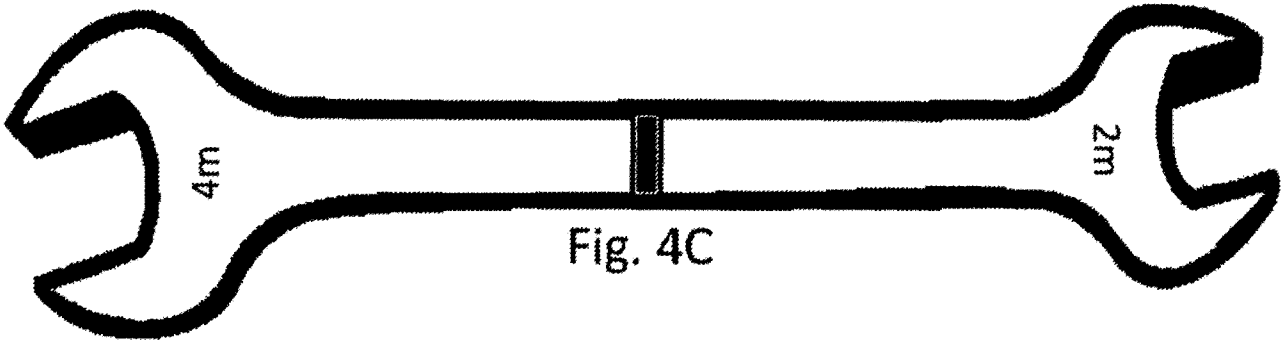
FIG. 4C is an illustration of one embodiment of the present invention.

FIGS. 4B and 4C illustrate the unified marking system indicia in Chart 4 for an SAE double open end wrench as illustrated in FIG. 4B, and for a metric standard double open end wrench as illustrated in FIG. 4C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 4

SEQUENTIAL MARKING FOR COMBINATION SAE-METRIC WRENCH OR SOCKET SETS

| SAE (Distance Across Flats) (inches) | METRIC (Distance Across Flats) (mm) | PRESESNT INVENTION (Sequential Marking) | PRESESNT INVENTION (Wrench Color Marking) |
|---|---|---|---|
| 5/32 | | 1 | Color A |
| | 4 | 2 m | Color B |
| 3/16 | | 3 | Color A |
| | 5 | 4 m | Color B |
| 7/32 | | 5 | Color A |
| | 6 | 6 m | Color B |
| 1/4 | | 7 | Color A |
| | 7 | 8 m | Color B |
| 9/37 | | 9 | Color A |
| 5/16 | | 10 | Color A |
| | 8 | 11 m | Color B |
| | 9 | 12 m | Color B |
| 3/8 | | 13 | Color A |
| | 10 | 14 m | Color B |
| | 11 | 15 m | Color B |
| 7/16 | | 16 | Color A |
| | 12 | 17 m | Color B |
| 1/2 | | 18 | Color A |
| | 13 | 19 m | Color B |
| | 14 | 21 m | Color B |
| 9/16 | | 22 | Color A |
| | 15 | 23 m | Color B |
| 5/8 | | 24 | Color A |
| | 16 | 25 m | Color B |
| | 17 | 26 m | Color B |
| 11/16 | | 27 | Color A |
| | | 28 m | Color B |
| | 19 | 29 m | Color B |
| 3/4 | | 30 | Color A |
| | 20 | 31 m | Color B |
| 13/16 | | 32 | Color A |
| | 21 | 33 m | Color B |
| | 22 | 34 m | Color B |
| 7/8 | | 35 | Color A |
| | 23 | 36 m | Color B |
| 15/16 | | 37 | Color A |
| | 24 | 38 m | Color B |
| | 25 | 39 m | Color B |
| 1 | | 40 | Color A |
| | 26 | 41 m | Color B |

Chart 5 illustrates one method of the present invention's unified marking system for SAE and metric standard tools. As an example, Chart 5 illustrates a relative size marking system that ranks SAE and metric tools from smallest to largest. The chart also illustrates the relative size markings in millimeters times 10 (rounded off to the nearest millimeter).

Figure 5A:
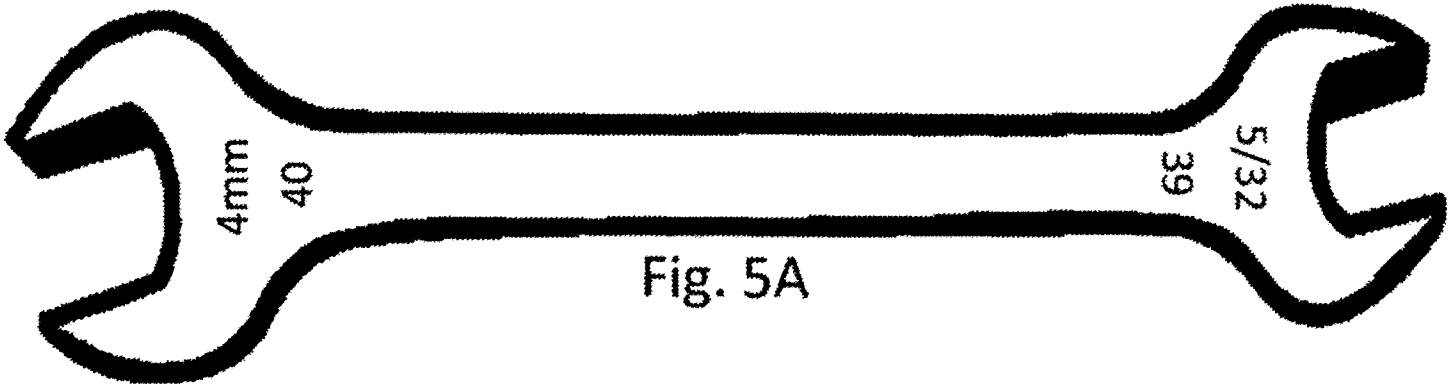
FIG. 5A is an illustration of one embodiment of the present invention.

One method of using the unified marking system indicia in Chart 5 is illustrated in FIG. 5A for a combination SAE-metric standard double open end wrench.

Figures 5B, 5C:
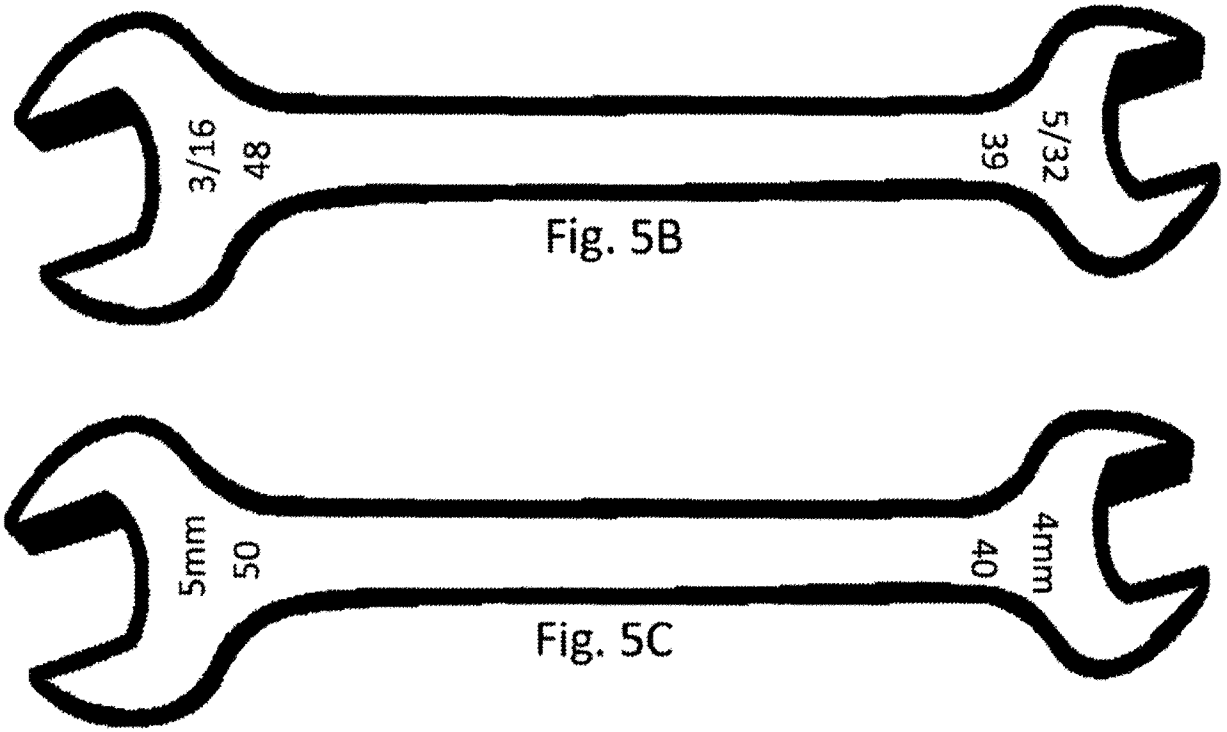
FIG. 5B is an illustration of one embodiment of the present invention.
FIG. 5C is an illustration of one embodiment of the present invention.

FIGS. 5B and 5C illustrate the unified marking system indicia in Chart 5 for an SAE double open end wrench as illustrated in FIG. 5B, and for a metric standard double open end wrench as illustrated in FIG. 5C.

A user working on a machine, object, etc. could easily conclude which wrench, is the nearest size up or down, from the wrench they incorrectly chose when trying to size the right wrench to a fastener, regardless of whether the fastener is sized according to an SAE or metric standard.

CHART 5

RELATIVE SIZE MARKING-(mm × 10) FOR COMBINATION SAE-METRIC WRENCH OR SOCKETS SETS

| SAE (Distance Across Flats) (inches) | METRIC (Distance Across Flats) (mm) | PRESENT INVENTION (Alternative Marking Relative Size-mm × 10) |
|---|---|---|
| 5/32 | | 39 |
| | 4 | 40 |
| 3/16 | | 48 |
| | 5 | 50 |
| 7/32 | | 56 |
| | 6 | 60 |
| 1/4 | | 64 |
| | 7 | 70 |
| 9/32 | | 71 |
| 5/16 | | 79 |
| | 8 | 80 |
| | 9 | 90 |
| 3/8 | | 95 |
| | 10 | 100 |
| | 11 | 110 |
| 7/16 | | 111 |
| | 12 | 120 |
| 1/2 | | 127 |
| | 13 | 130 |
| | 14 | 140 |
| 9/16 | | 143 |
| | 15 | 150 |
| 5/8 | | 159 |
| | 16 | 160 |
| | 17 | 170 |
| 11/16 | | 175 |
| | 18 | 180 |
| | 19 | 190 |
| 3/4 | | 191 |
| | 20 | 200 |
| 13/16 | | 206 |
| | 21 | 210 |
| | 22 | 220 |
| 7/8 | | 222 |
| | 23 | 230 |
| 15/16 | | 238 |
| | 24 | 240 |
| | 25 | 250 |
| 1 | | 254 |
| | 26 | 260 |

Chart 6 illustrates one method of the present invention's unified marking system for SAE and metric standard tools. Chart 6 illustrates a relative size marking system that ranks SAE and metric tools from smallest to largest. Chart 6 also includes a letter "m" added to the sequential indicia to indicate whether the tool is sized for the metric system. The chart also illustrates the relative size markings in millimeters limes 10 (rounded off to the nearest millimeter).

Figure 6A:
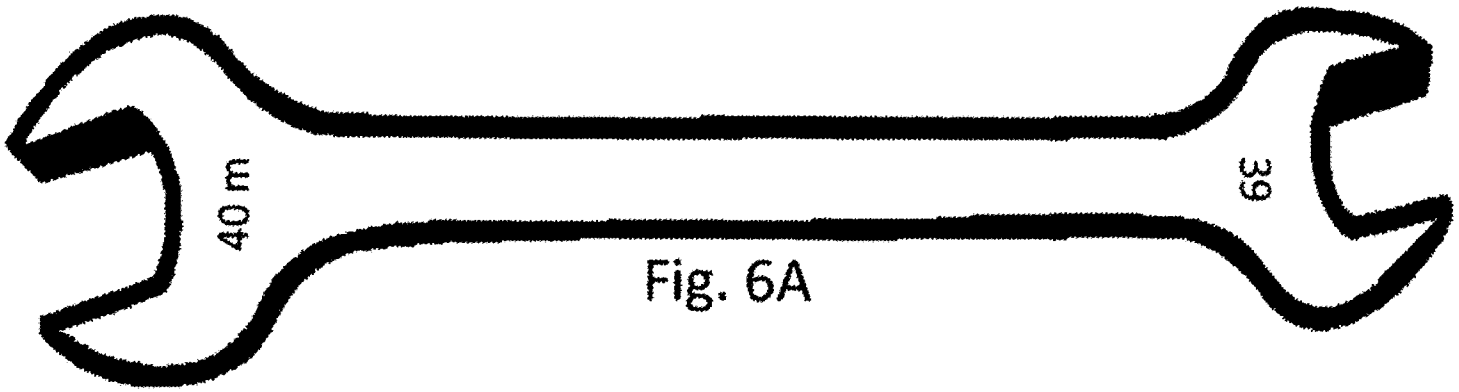
FIG. 6A is an illustration of one embodiment of the present invention.

One method of using the unified marking system indicia in Chart 6 is illustrated in FIG. 6A for a combination SAE-metric standard double open end wrench.

Figure 6B:
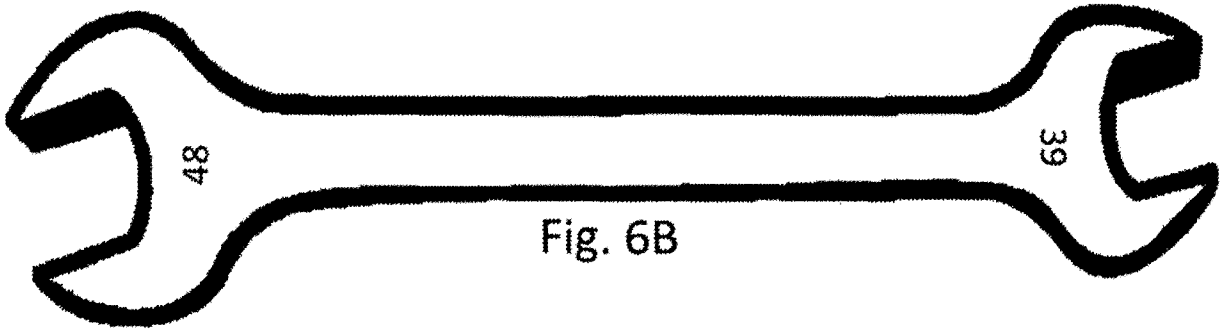
FIG. 6B is an illustration of one embodiment of the present invention.
Figure 6C:
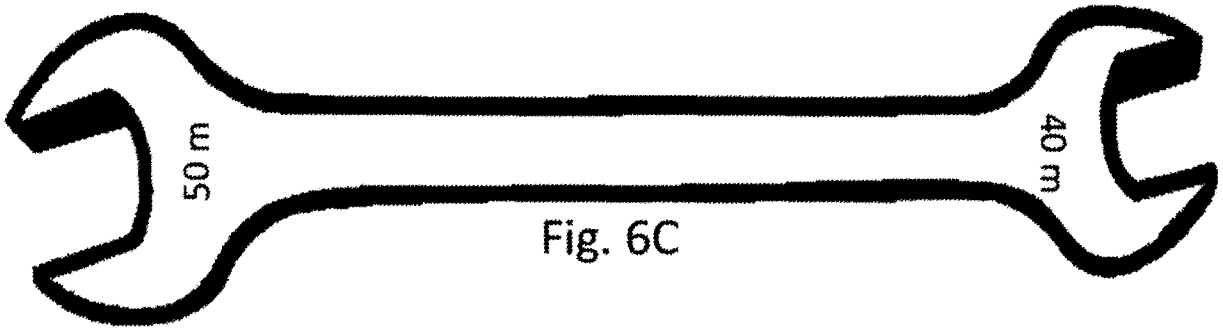
FIG. 6C is an illustration of one embodiment of the present invention.

FIGS. 6B and 6C illustrate the unified marking system indicia in Chart 6 for an SAE double open end wrench as illustrated in FIG. 6B, and for a metric standard double open end wrench as illustrated in FIG. 6C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 6

RELATIVE SIZE MARKING-(mm × 10) FOR COMBINATION SAE-METRIC WRENCH OR SOCKETS SETS

| SAE (Distance Across Flats) (inches) | METRIC (Distance Across Flats) (mm) | PRESENT INVENTION (Alternative Marking Relative Size-mm × 10, Where "m" indicates Metric) |
|---|---|---|
| 5/32 | | 39 |
| | 4 | 40 m |
| 3/16 | | 48 |
| | 5 | 50 m |
| 7/32 | | 50 |
| | 6 | 60 m |
| 1/4 | | 64 |
| | 7 | 70 m |
| 9/32 | | 71 |
| 5/16 | | 79 |
| | 8 | 80 m |
| | 9 | 90 m |
| 3/8 | | 95 |
| | 10 | 100 m |
| | 11 | 110 m |
| 7/16 | | 111 |
| | 12 | 120 m |
| 1/2 | | 127 |
| | 13 | 130 m |
| | 14 | 140 m |
| 9/16 | | 143 |
| | 15 | 150 m |
| 5/8 | | 159 |
| | 16 | 160 m |
| | 17 | 170 |
| 11/16 | | 175 |
| | 18 | 180 m |
| | 19 | 190 m |
| 3/4 | | 191 |
| | 20 | 200 m |
| 13/16 | | 206 |
| | 21 | 210 m |
| | 22 | 220 m |
| 7/8 | | 222 |
| | 23 | 230 m |
| 15/16 | | 238 |
| | 24 | 240 m |
| | 25 | 250 m |
| 1 | | 254 |
| | 26 | 260 m |

Chart 7 illustrates one method of the present invention's unified marking system for SAE and metric standard tools. Chart 7 illustrates a relative size marking system that ranks SAE and metric tools from smallest to largest. The chart also illustrates the relative size markings in millimeters time 10 (rounded off to the nearest millimeter). Chart 7 also includes a two color code to indicate whether the tool is sized for the SAE or metric system. As an example in FIGS. 7B and 7C, the color green indicates the tool is sized (or SAE, and the color red indicates the tool is sized for metric.

Figure 7A:
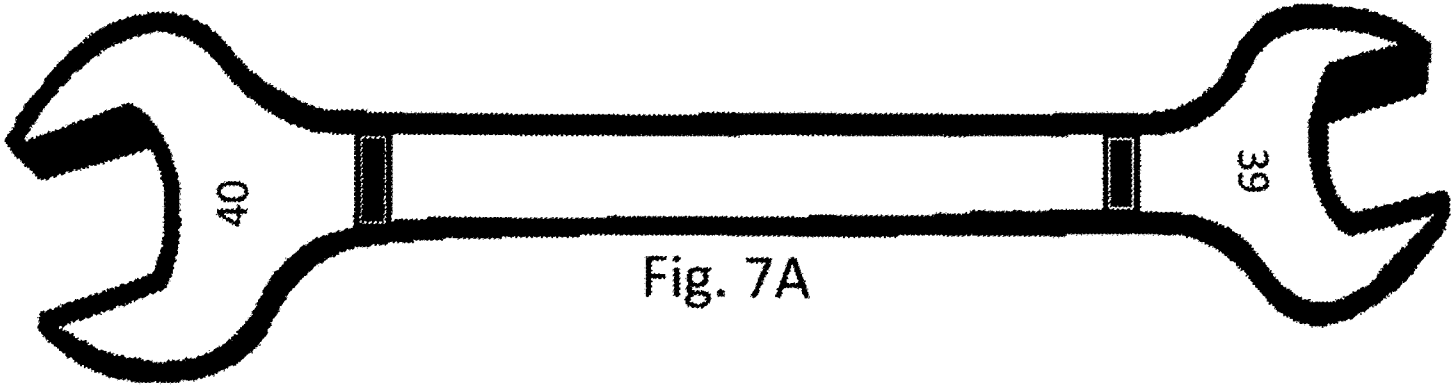
FIG. 7A is an illustration of one embodiment of the present invention.

One method of using the unified marking system indicia in Chart 7 is illustrated in to FIG. 7A for a combination SAE-metric standard double open end wrench.

Figure 7B:
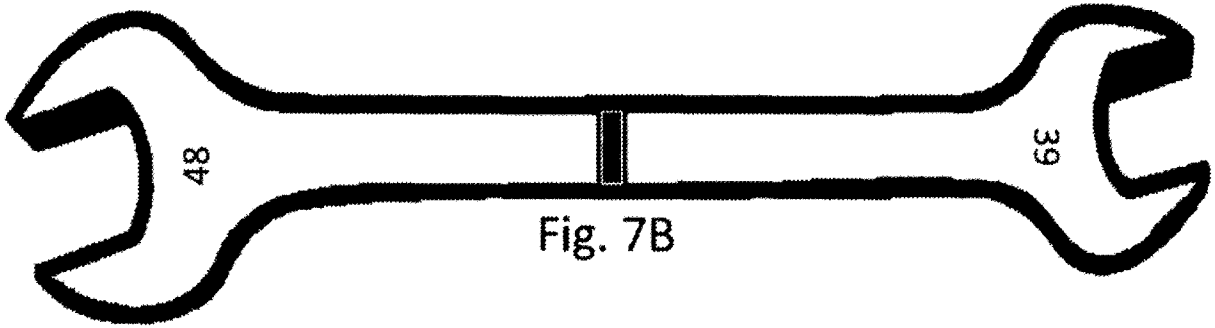
FIG. 7B is an illustration of one embodiment of the present invention.
Figure 7C:
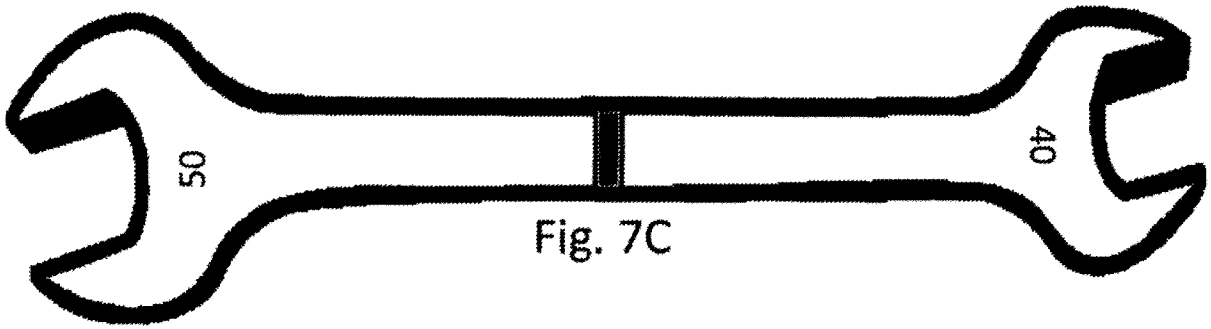
FIG. 7C is an illustration of one embodiment of the present invention.

FIGS. 7B and 7C illustrate the unified marking system indicia in Chart 7 for an SAE double open end wrench as illustrated in FIG. 7B, and for a metric standard double open end wrench as illustrated in FIG. 7C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 7

RELATIVE SIZE MARKING-(mm × 10) FOR COMBINATION SAE-METRIC WRENCH OR SOCKET SETS

| SAE (Distance Across Flats) (inches) | METRIC (Distance Across Flats) (mm) | PRESESNT INVENTION (Sequential Marking) | PRESENT INVENTION (Wrench Color Marking) |
|---|---|---|---|
| 5/32 | | 39 | Color A |
| | 4 | 40 | Color B |
| 3/16 | | 48 | Color A |
| | 5 | 50 | Color B |
| 7/32 | | 56 | Color A |
| | 6 | 60 | Color B |
| 1/4 | | 64 | Color A |
| | 7 | 70 | Color B |
| 9/32 | | 71 | Color A |
| 5/16 | | 79 | Color A |
| | 8 | 80 | Color B |
| | 9 | 90 | Color B |
| 3/8 | | 95 | Color A |
| | 10 | 100 | Color B |
| | 11 | 110 | Color B |
| 7/16 | | 111 | Color A |
| | 12 | 120 | Color B |
| 1/2 | | 127 | Color A |
| | 13 | 130 | Color B |
| | 14 | 140 | Color B |
| 9/16 | | 143 | Color A |
| | 15 | 150 | Color B |
| 5/8 | | 159 | Color A |
| | 16 | 160 | Color B |
| | 17 | 170 | Color B |
| 11/16 | | 175 | Color A |
| | 18 | 180 | Color B |
| | 19 | 190 | Color B |
| 3/4 | | 191 | Color A |
| | 20 | 200 | Color B |
| 13/16 | | 206 | Color A |
| | 21 | 210 | Color B |
| | 22 | 220 | Color B |
| 7/8 | | 222 | Color A |
| | 23 | 230 | Color B |
| 15/16 | | 238 | Color A |
| | 24 | 240 | Color B |
| | 25 | 250 | Color B |
| 1 | | 254 | Color A |
| | 26 | 260 | Color B |

Chart 8 illustrates one method of the present invention's unified marking system for SAE and metric standard tools. Chart 8 illustrates a relative size marking system that ranks SAE and metric tools from smallest to largest. Chart 8 also includes a two color code to indicate whether the tool is sized for the SAE or metric system. As an example in FIGS. 8B and 8C, the color green indicates the tool is sized for SAE, and the color red indicates the tool is sized for metric. Chart 8 also includes a letter "m" added to the sequential indicia to further indicate whether the tool is sized for the metric system. The chart also illustrates the relative size markings in millimeters times 10 (rounded off to the nearest millimeter).

Figure 8A:
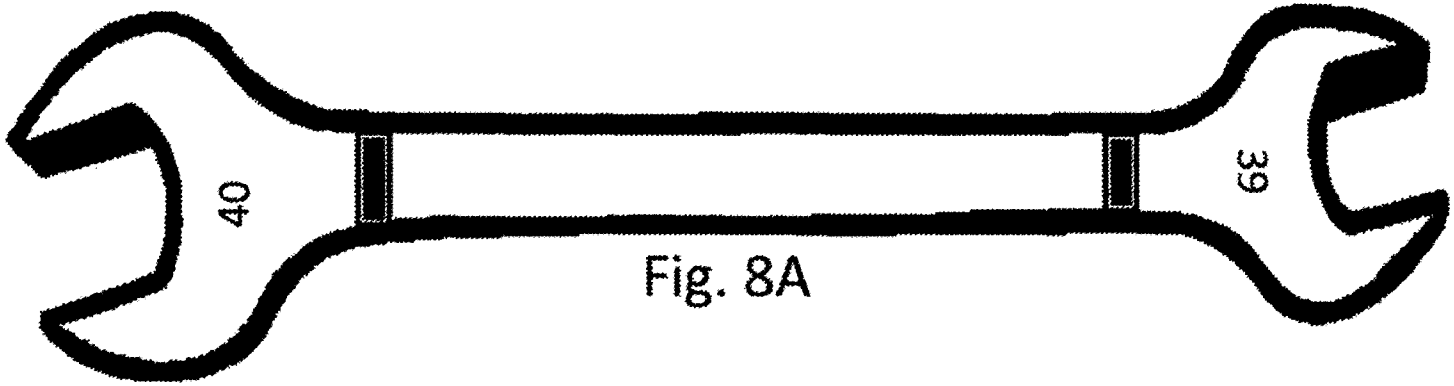
FIG. 8A is an illustration of one embodiment of the present invention.

One method of using the unified marking system indicia in Chart 8 is illustrated in FIG. 8A for a combination SAE-metric standard double open end wrench.

Figure 8B:
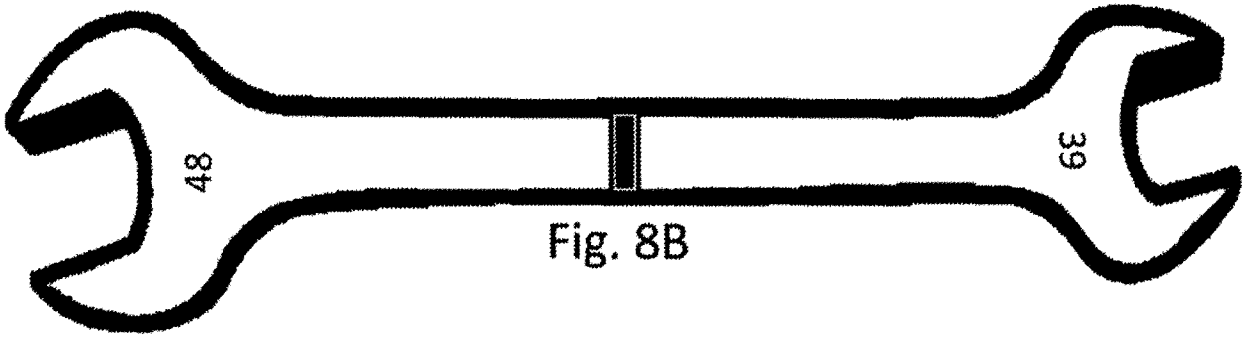
FIG. 8B is an illustration of one embodiment of the present invention.
Figure 8C:
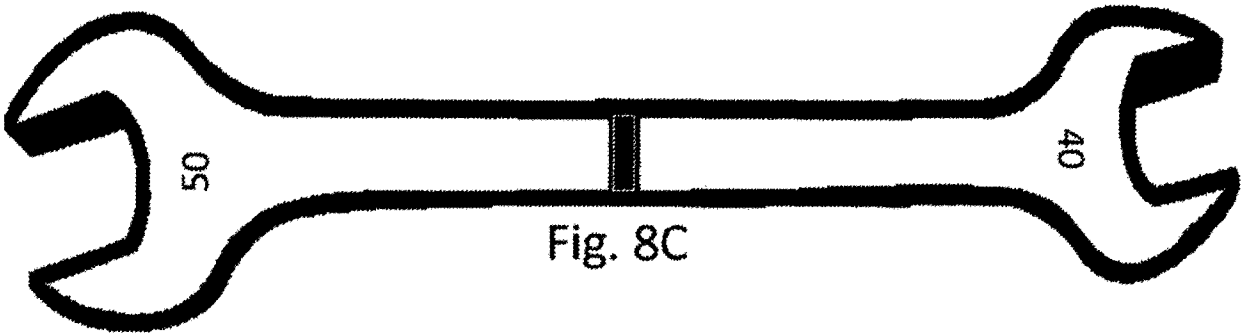
FIG. 8C is an illustration of one embodiment of the present invention.

FIGS. 8B and 8C illustrate the unified marking system indicia in Chart 8 for an SAE double open end wrench as illustrated in FIG. 8B, and for a metric standard double open end wrench as illustrated in FIG. 8C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 8

RELATIVE SIZE MARKING-(mm × 10) FOR COMBINATION SAE-METRIC WRENCH OR SOCKET SETS

| SAE (Distance Across Flats) (inches) | METRIC (Distance Across Flats) (mm) | PRESESNT INVENTION (Alternative Marking Relative Size-mm × 10, Where "m" Indicates Metric) | PRESENT INVENTION (Wrench Color Marking) |
|---|---|---|---|
| 5/32 | | 39 | Color A |
| | 4 | 40 m | Color B |
| 3/16 | | 48 | Color A |
| | 5 | 50 m | Color B |
| 7/32 | | 56 | Color A |
| | 6 | 60 m | Color B |
| 1/4 | | 64 | Color A |
| | 7 | 70 m | Color B |
| 9/32 | | 71 | Color A |
| 5/16 | | 79 | Color A |
| | 8 | 80 m | Color B |
| | 9 | 90 m | Color B |
| 3/8 | | 95 | Color A |
| | 10 | 100 m | Color B |
| | 11 | 110 m | Color B |
| 7/16 | | 111 | Color A |
| | 12 | 120 m | Color B |
| 1/2 | | 127 | Color A |
| | 13 | 130 m | Color B |
| | 14 | 140 m | Color B |
| 9/16 | | 143 | Color A |
| | 15 | 150 m | Color B |
| 5/8 | | 159 | Color A |
| | 16 | 160 m | Color B |
| | 17 | 170 m | Color B |
| 11/16 | | 175 | Color A |
| | 18 | 180 m | Color B |
| | 19 | 190 m | Color B |
| 3/4 | | 191 | Color A |
| | 20 | 200 m | Color B |
| 13/16 | | 206 | Color A |
| | 21 | 210 m | Color B |
| | 22 | 220 m | Color B |
| 7/8 | | 222 | Color A |
| | 23 | 230 m | Color B |
| 15/16 | | 238 | Color A |
| | 24 | 240 m | Color B |
| | 25 | 250 m | Color B |
| 1 | | 254 | Color A |
| | 26 | 260 m | Color B |

Figure 9A:
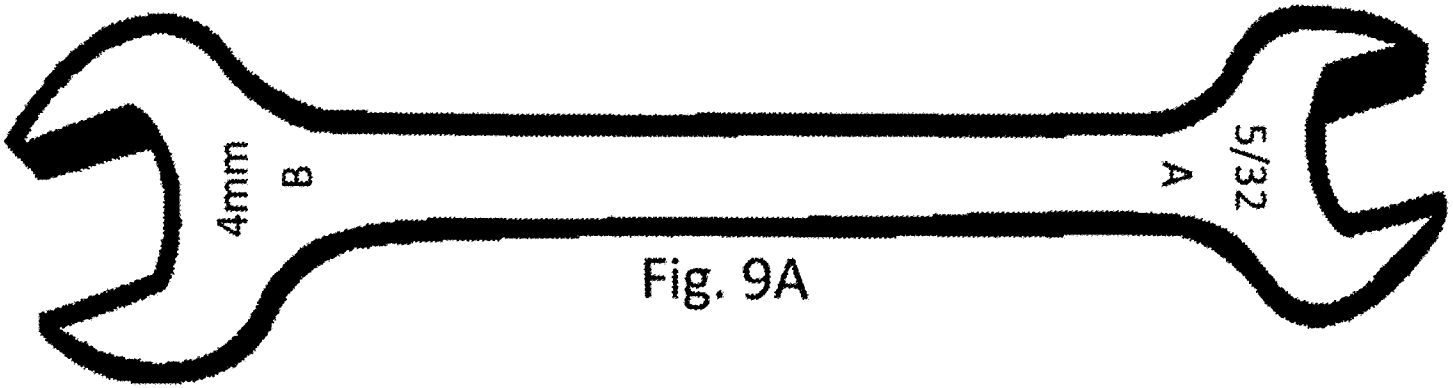
FIG. 9A is an illustration of one embodiment of the present invention.

One method of using the unified marking system indicia in Chart 9 is illustrated in FIG. 9A for a combination SAE-metric standard double open end wrench.

Figure 9B:
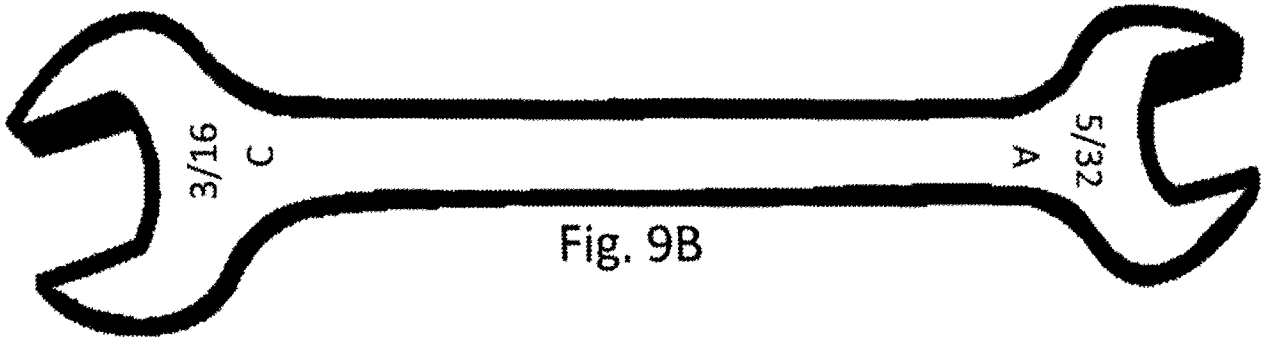
FIG. 9B is an illustration of one embodiment of the present invention.
Figure 9C:
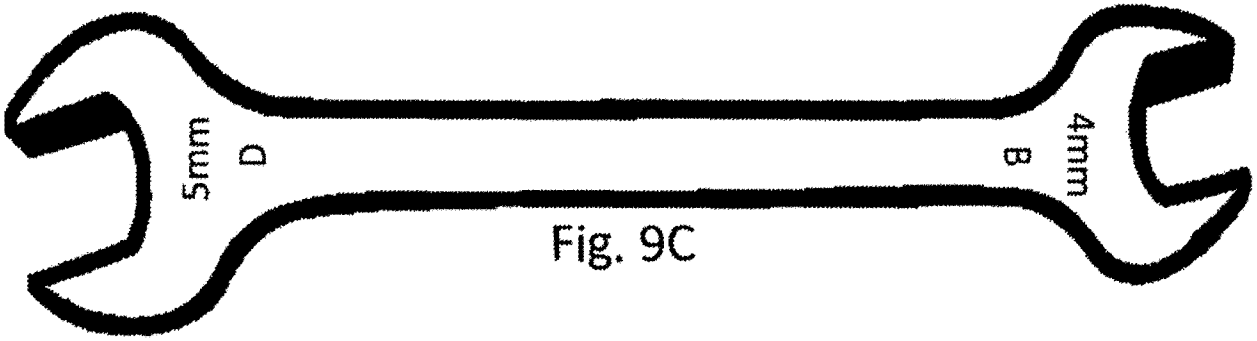
FIG. 9C is an illustration of one embodiment of the present invention.

FIGS. 9B and 9C illustrate the unified marking system indicia in Chart 9 for an SAE double open end wrench as illustrated in FIG. 9B, and for a metric standard double open end wrench as illustrated in FIG. 9.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 9

SEQUENTIAL MARKINC FOR COMBINATION SAE-METRIC WRENCH OR SOCKET SETS

| SAE (Distance Across Flats) (inches) | METRIC (Distance Across Flats) (mm) | PRESESNT INVENTION (Sequential Marking) |
|---|---|---|
| 5/32 | | A |
| | 4 | B |
| 3/16 | | C |
| | 5 | D |
| 7/32 | | E |
| | 6 | F |
| 1/4 | | G |
| | 7 | H |
| 9/32 | | I |
| 5/16 | | J |
| | 8 | K |
| | 9 | L |
| 3/8 | | M |
| | 10 | N |
| | 11 | O |
| 7/16 | | P |
| | 12 | Q |
| 1/2 | | R |
| | 13 | S |
| | 14 | T |
| 9/16 | | U |
| | 15 | V |
| 5/8 | | W |
| | 16 | X |
| | 17 | Y |
| 11/16 | | Z |
| | 18 | AA |
| | 19 | BB |
| 3/4 | | CC |
| | 20 | DD |
| 13/16 | | EE |
| | 21 | FF |
| | 22 | GG |
| 7/8 | | HH |
| | 23 | II |
| 15/16 | | JJ |
| | 24 | KK |
| | 25 | LL |
| 1 | | MM |
| | 26 | NN |

Chart 10 illustrates one method of the present invention's unified marking system for SAE and metric standard tools. Chart 10 illustrates a sequential marking system that ranks SAE and metric tools from smallest to largest. Chart 10 also includes a letter "m" added to the sequential indicia to indicate whether the tool is sized for the metric system.

Figure 10A:
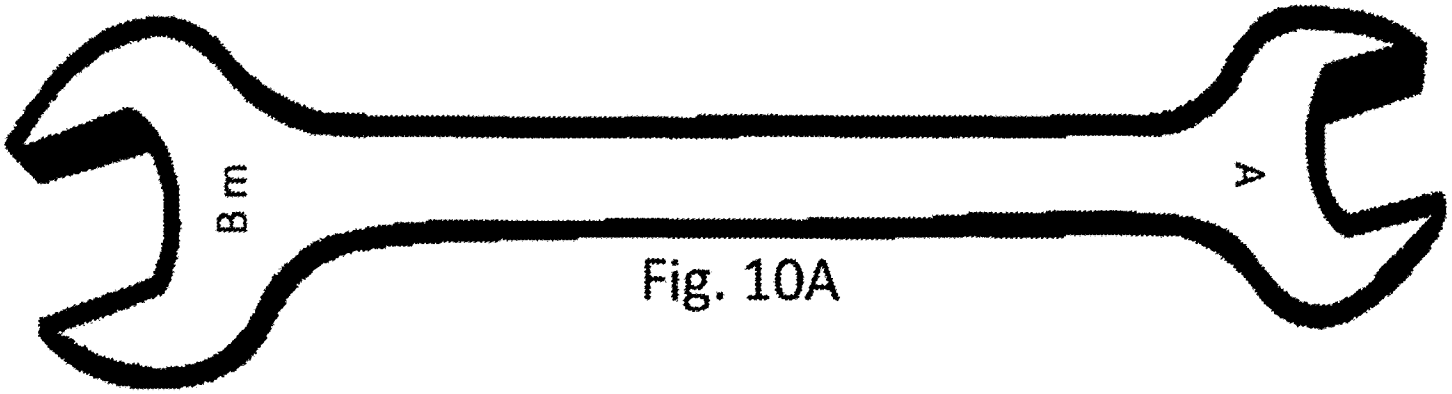
FIG. 10A is an illustration of one embodiment of the present invention.

One method of using the unified marking system indicia in Chart 10 is illustrated in FIG. 10A for a combination SAE-metric standard double open end wrench.

Figures 10B, 10C:
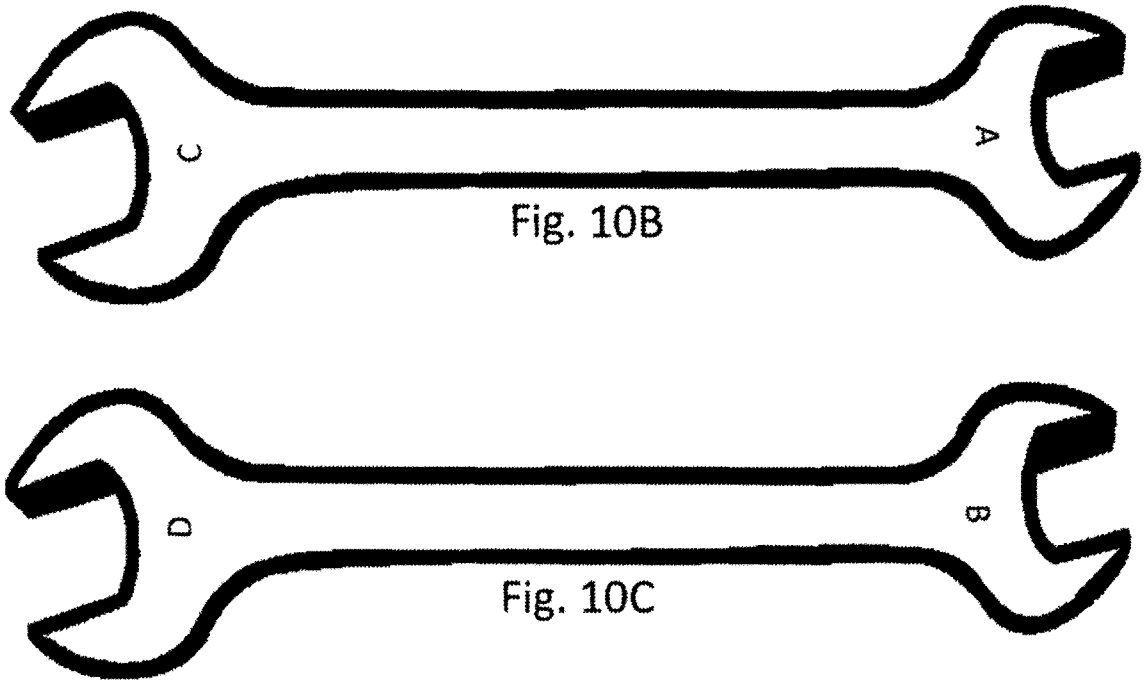
FIG. 10B is an illustration of one embodiment of the present invention.
FIG. 10C is an illustration of one embodiment of the present invention.

FIGS. 10B and 10C illustrate the unified marking system indicia in Chart 10 for an SAE double open end wrench as illustrated in FIG. 10B, and for a metric standard double open end wrench as illustrated in FIG. 10C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 10

SEQUENTIAL MARKING FOR COMBINATION SAE-METRIC WRENCH OR SOCKET SETS

| SAE (Distance Across Flats) (inches) | METRIC (Distance Across Flats) (mm) | PRESESNT INVENTION (Alternative Sequential Marking Where "m" indicates Metric) |
|---|---|---|
| 5/32 | | A |
| | 4 | B m |
| 3/16 | | C |
| | 5 | D m |
| 7/32 | | E |
| | 6 | F m |
| 1/4 | | G |
| | 7 | H m |
| 9/32 | | I |
| 5/16 | | J |
| | 8 | K m |
| | 9 | L m |
| 3/8 | | M |
| | 10 | N m |
| | 11 | O m |
| 7/16 | | P |
| | 12 | Q m |
| 1/2 | | R |
| | 13 | S m |
| | 14 | T m |
| 9/16 | | U |
| | 15 | V m |
| 5/8 | | W |
| | 16 | X m |
| | 17 | Y m |
| 11/16 | | Z |
| | 18 | AA m |
| | 19 | BB m |
| 3/4 | | CC |
| | 20 | DD m |
| 13/16 | | EE |
| | 21 | FF m |
| | 22 | GG m |
| 7/8 | | HH |
| | 23 | II m |
| 15/16 | | JJ |
| | 24 | KK m |
| | 25 | LL m |
| 1 | | MM |
| | 26 | NN m |

Chart 11 illustrates one method of the present invention's unified marking system for SAE and metric standard tools. Chart 11 illustrates a sequential marking system that ranks SAE and metric tools from smallest to largest. Chart 11 also includes a two color code to indicate whether the tool is sized for the SAE or metric system. As an example, in FIG. 11B the color green indicates the tool is sized for SAE, and FIG. 11C, the color red indicates the tool is sized for metric.

Figure 11A:
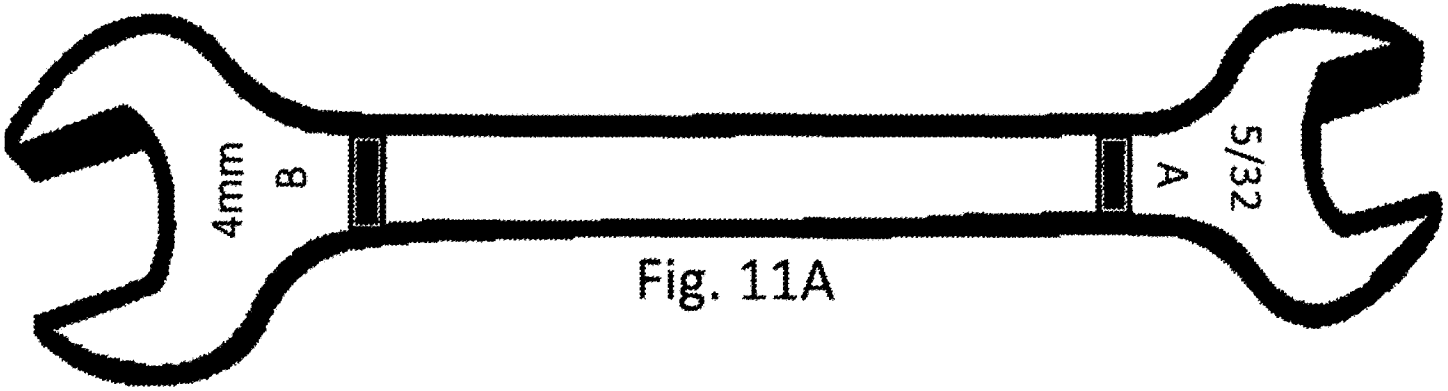
FIG. 11A is an illustration of one embodiment of the present invention.

One method of using the unified marking system indicia in Chart 11 is illustrated in FIG. 11A for a combination SAE-metric standard double open end wrench.

Figure 11B:
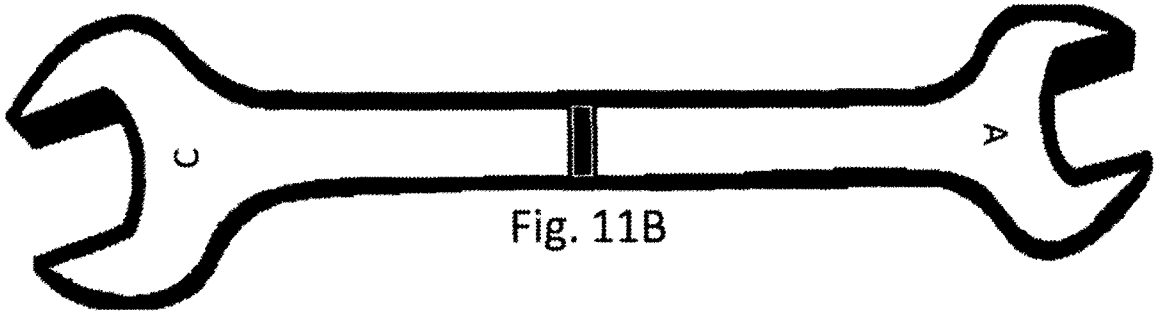
FIG. 11B is an illustration of one embodiment of the present invention.
Figure 11C:
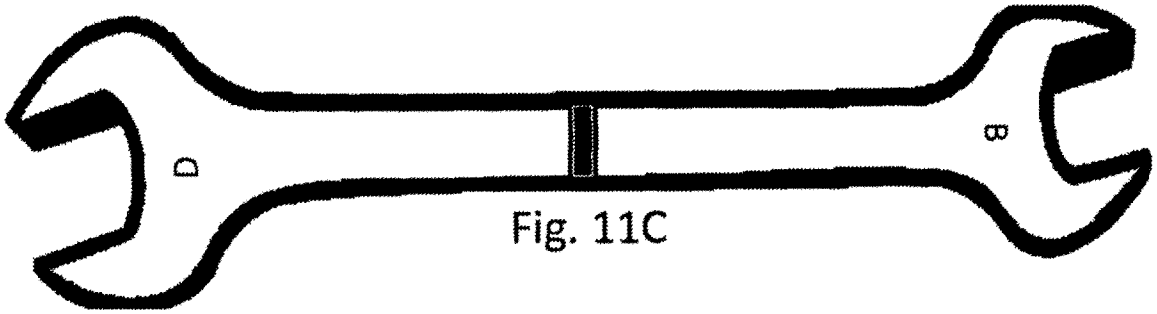
FIG. 11C is an illustration of one embodiment of the present invention.

FIGS. 11B and 11C illustrate the unified marking system indicia in Chart 11 for an SAE double open end wrench as illustrated in FIG. 11B, and for a metric standard double open end wrench as illustrated in FIG. 11C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 11

SEQUENTIAL MARKING FOR COMBINATION SAE-METRIC WRENCH OR SOCKET SETS

| SAE (Distance Across Flats) (inches) | METRIC (Distance Across Flats) (mm) | PRESESNT INVENTION (Sequential Marking) | PRESENT INVENTION (Wrench Color Marking) |
|---|---|---|---|
| 5/32 | | A | Color A |
| | 4 | B | Color B |
| 3/16 | | C | Color A |
| | 5 | D | Color B |
| 7/32 | | E | Color A |
| | 6 | F | Color B |
| 1/4 | | G | Color A |
| | 7 | H | Color B |
| 9/32 | | I | Color A |
| 5/16 | | J | Color A |
| | 8 | K | Color B |
| | 9 | L | Color B |
| 3/8 | | M | Color A |
| | 10 | N | Color B |
| | 11 | O | Color B |
| 7/16 | | P | Color A |
| | 12 | Q | Color B |
| 1/2 | | R | Color A |
| | 13 | S | Color B |
| | 14 | T | Color B |
| 9/16 | | U | Color A |
| | 15 | V | Color B |
| 5/8 | | W | Color A |
| | 16 | X | Color B |
| | 17 | Y | Color B |
| 11/16 | | Z | Color A |
| | 18 | AA | Color B |
| | 19 | BB | Color B |
| 3/4 | | C | Color A |
| | 20 | DD | Color B |
| 13/16 | | EE | Color A |
| | 21 | FF | Color B |
| | 22 | GG | Color B |
| 7/8 | | HH | Color A |
| | 23 | II | Color B |
| 15/16 | | JJ | Color A |
| | 24 | KK | Color B |
| | 25 | LL | Color B |
| 1 | | MM | Color A |
| | 26 | NN | Color B |

Chart 12 illustrates one method of the present invention's unified marking system for SAE and metric standard tools. Chart 12 illustrates a sequential marking system that ranks SAE and metric tools from smallest to largest. Chart 12 also includes a two color code to indicate whether the tool is sized for the SAE or metric system. As an example in FIG. 12*b* the color green indicates the tool is sized for SAE, and FIG. 12C the color red indicates the tool is sized for metric. Chart 12 also includes a letter "m" added to the sequential indicia to further indicate whether the tool is sized for the metric system.

Figure 12A:
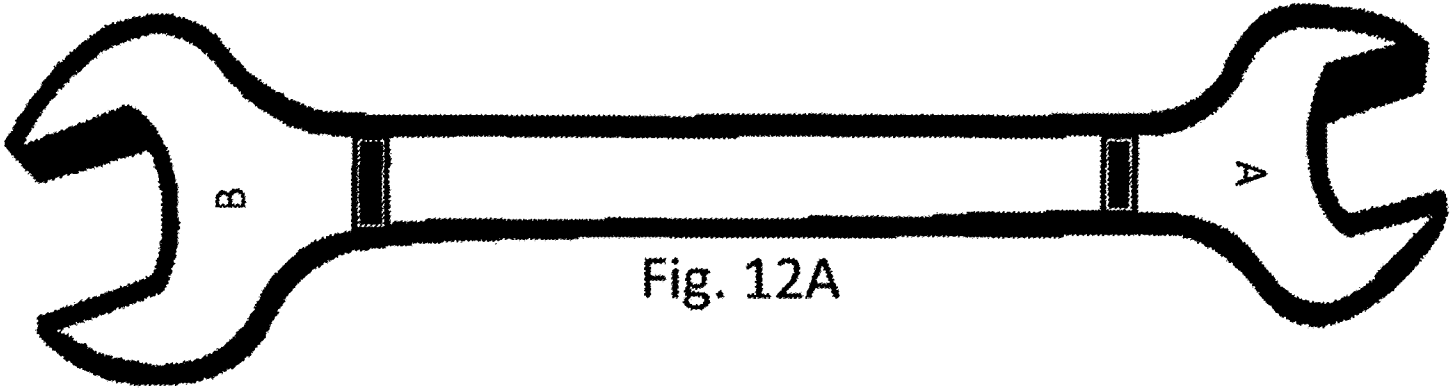
FIG. 12A is an illustration of one embodiment of the present invention.

One method of using the unified marking system indicia in Chart 12 is illustrated in FIG. 12A for a combination SAE-metric standard double open end wrench.

Figure 12B:
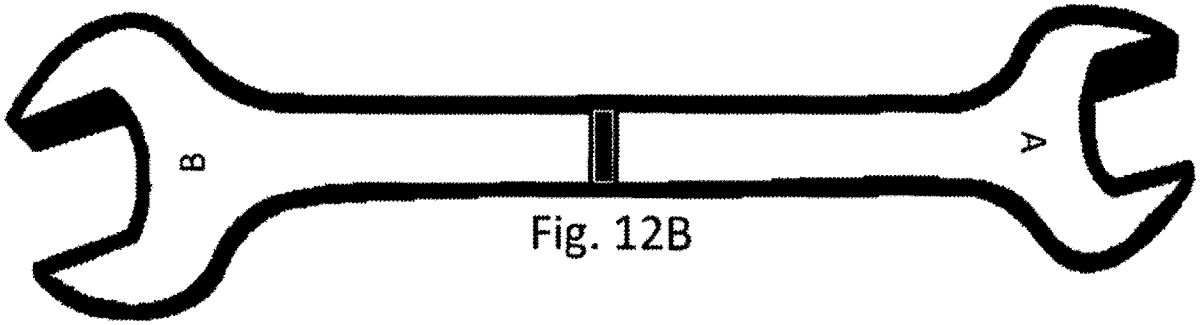
FIG. 12B is an illustration of one embodiment of the present invention.
Figure 12C:
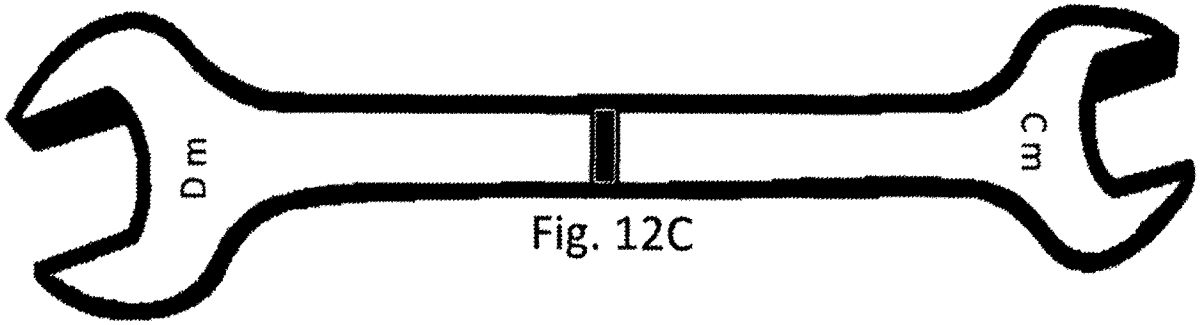
FIG. 12C is an illustration of one embodiment of the present invention.

FIGS. 12B and 12C illustrate the unified marking system indicia in Chart 12 for an SAE double open end wrench as illustrated in FIG. 12B, and for a metric standard double open end wrench as illustrated in FIG. 12C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 12

| SEQUENTIAL MARKING FOR COMBINATION SAE-METRIC WRENCH OR SOCKET SETS | | | |
|---|---|---|---|
| SAE (Distance Across Flats) (inches) | METRIC (Distance Across Flats) (mm) | (Alternative Sequential Marking Where "m" indicates Metric) | PRESENT INVENTION (Wrench Color Marking) |
| 5/32 | | A | Color A |
| | 4 | B m | Color B |
| 3/16 | | C | Color A |
| | 5 | D m | Color B |
| 7/32 | | E | Color A |
| | 6 | Fm | Color B |
| 1/4 | | G | Color A |
| | 7 | H m | Color B |
| 9/32 | | I | Color A |
| 5/16 | | J | Color A |
| | 8 | K m | Color B |
| | 9 | Lm | Color B |
| 3/8 | | M | Color A |
| | 10 | N m | Color B |
| | 11 | O m | Color B |
| 7/16 | | P | Color A |
| | 12 | Q m | Color B |
| 1/2 | | R | Color A |
| | 13 | S m | Color B |
| | 14 | T m | Color B |
| 9/16 | | U | Color A |
| | 15 | V m | Color B |
| 5/8 | | W | Color A |
| | 16 | X m | Color B |
| | 17 | Y m | Color B |
| 11/16 | | Z | Color A |
| | 18 | AA m | Color B |
| | 19 | BB m | Color B |
| 3/4 | | CC | Color A |
| | 20 | DD m | Color B |
| 13/16 | | EE | Color A |
| | 21 | FF m | Color B |
| | 22 | GG m | Color B |
| 7/8 | | HH | Color A |
| | 23 | II m | Color B |
| 15/16 | | JJ | Color A |
| | 24 | KK m | Color B |
| | 25 | LL m | Color B |
| 1 | | MM | Color A |
| | 26 | NN m | Color B |

Chart 13 illustrates one method of the present invention's unified marking system for SAE and metric standard tools. Chart 13 illustrates a relative size marking system that ranks SAE, metric, and Whitworth tools from smallest to largest.

Figure 13A:
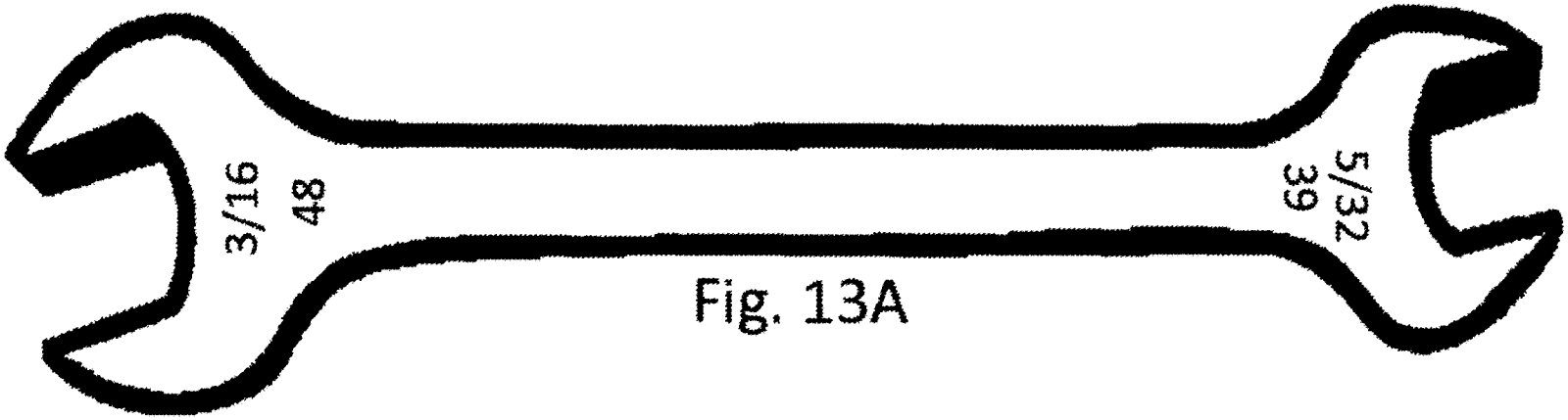
FIG. 13A is an illustration of one embodiment of the present invention.

One method of using the unified marking system indicia in Chart 13 is illustrated in FIG. 13A for a combination standard double open end wrench.

Figure 13B:
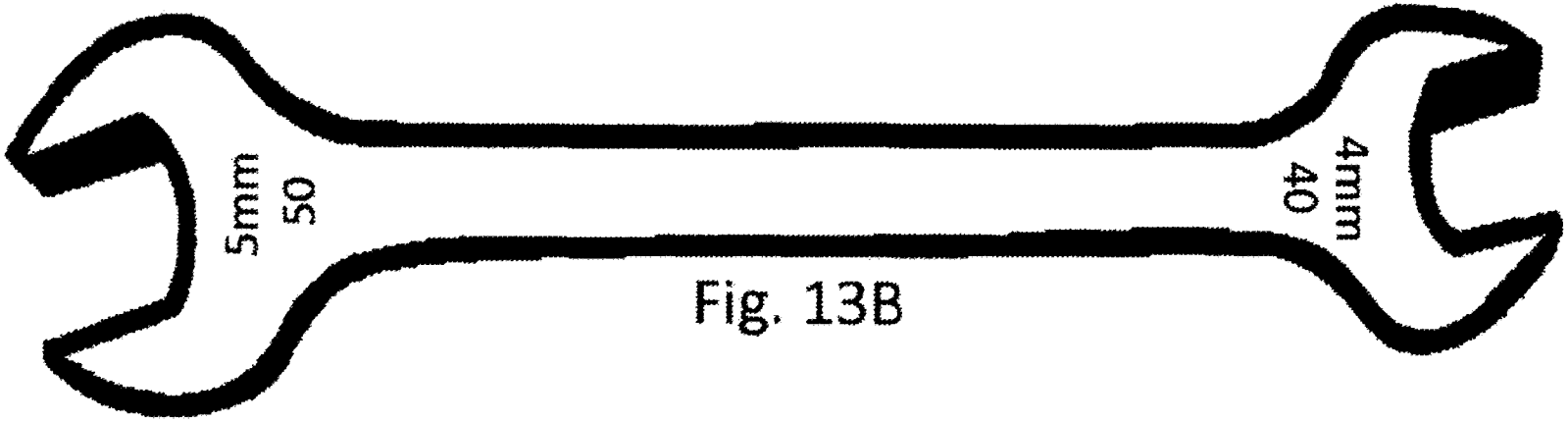
FIG. 13B is an illustration of one embodiment of the present invention.
Figure 13C:
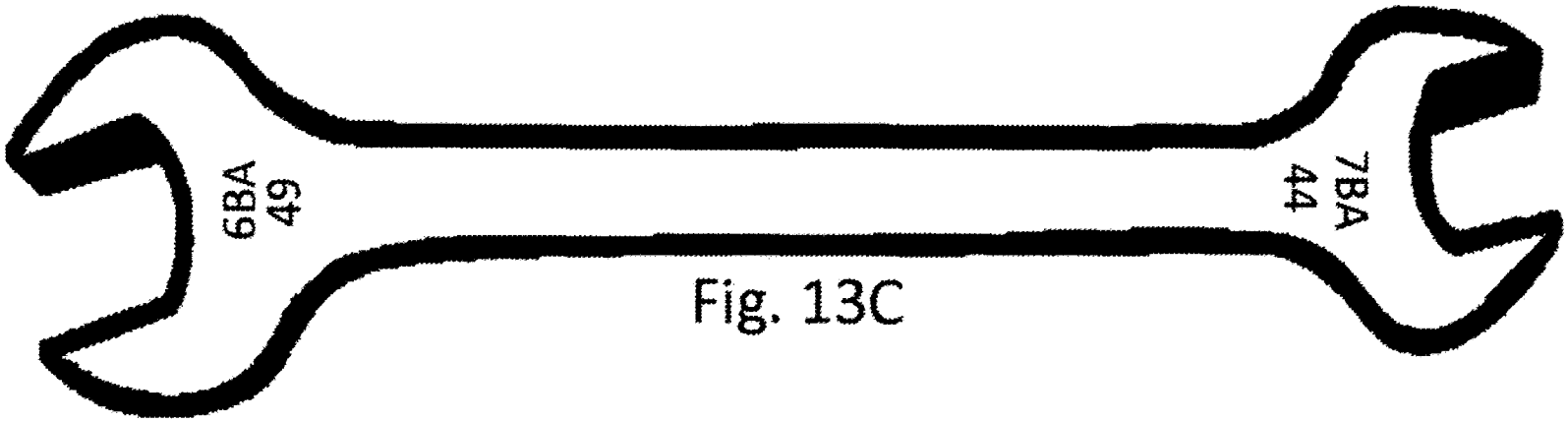
FIG. 13C is an illustration of one embodiment of the present invention.

FIGS. 13B, 13C, and 13*d* illustrate the unified marking system indicia in Chart 13 for an SAE double open end wrench as illustrated in FIG. 13B, for a metric standard double open end wrench as illustrated in FIG. 13C, and for a Whitworth standard double open end wrench as illustrated in FIG. 13D.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 13

| RELATIVE SIZE MARKING-(mm × 10) | | | |
|---|---|---|---|
| SAE (Distance Across Flats) (Inches) | METRIC (Distance Across Flats) (mm) | WHITWORTH DESIGNATION | PRESENT INVENTION (Alternative Marking Relative Size-mm × 10) |
| 5/32 | | | 39 |
| | 4 | | 40 |
| | | 7BA | 44 |
| 3/16 | | | 48 |
| | | 6BA | 49 |
| | 5 | | 50 |
| 7/32 | | | 55 |
| | | 5BA | 56 |
| | 6 | | 60 |
| | | 4BA | 63 |
| 1/4 | | | 64 |
| | 7 | | 70 |
| 9/32 | | | 71 |
| | | 3BA | 72 |
| 5/16 | | | 79 |
| | 8 | | 80 |
| | | 2BA | 82 |
| | 9 | | 90 |
| | | 1BA | 93 |
| 3/8 | | | 95 |
| | 10 | | 100 |
| | | 0BA | 105 |
| | 11 | | 110 |
| 7/16 | | | 111 |

Chart 14 illustrates one method of the present invention's unified marking system for SAE and metric standard tools. As an example, Chart 14 illustrates a relative size marking system that ranks SAE and metric tools from smallest to largest. The chart also illustrates the relative size markings in decimal millimeters.

Figure 14A:
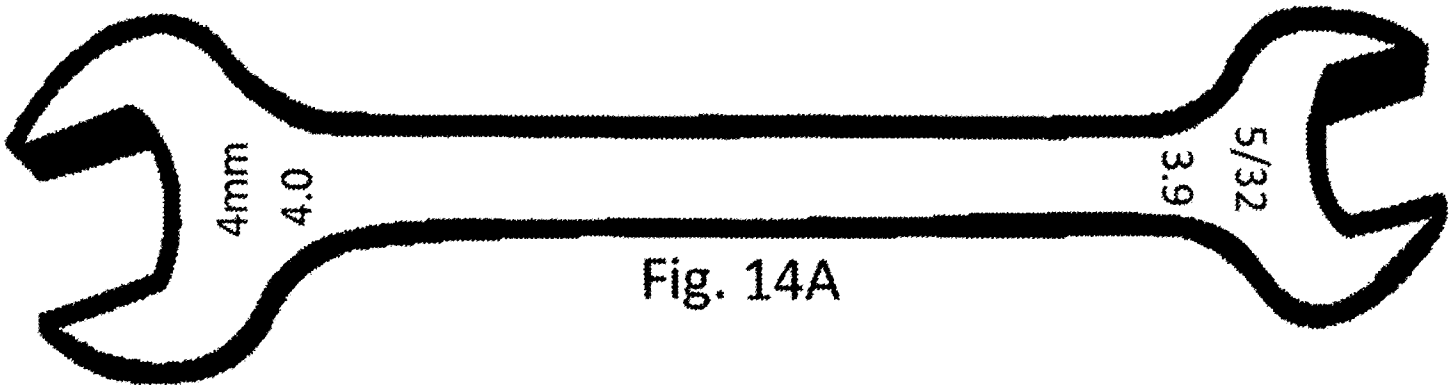
FIG. 14A is an illustration of one embodiment of the present invention.

One method of using the unified marking system indicia in Chart 14 is illustrated in FIG. 14A for a combination SAE-metric standard double open end wrench.

Figure 14B:
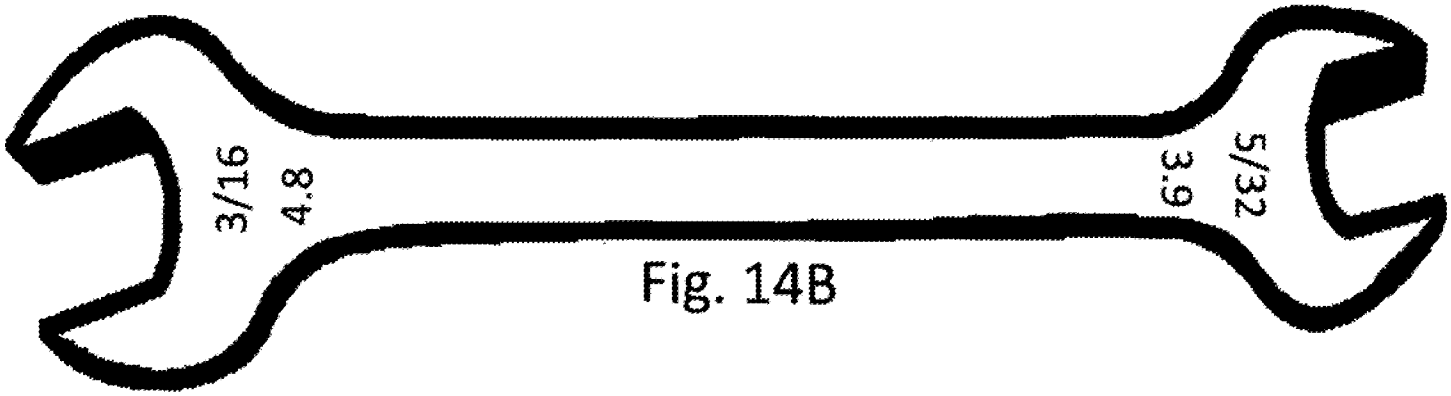
FIG. 14B is an illustration of one embodiment of the present invention.
Figure 14C:
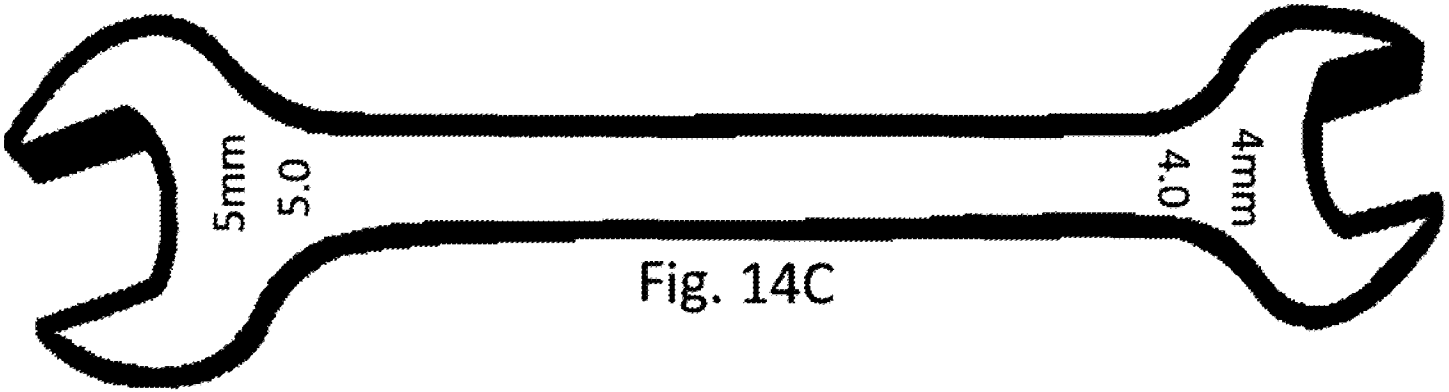
FIG. 14C is an illustration of one embodiment of the present invention.

FIGS. 14B and 14C illustrate the unified marking system indicia in Chart 5 for an SAE double open end wrench as illustrated in FIG. 14B, and for a metric standard double open end wrench as illustrated in FIG. 14C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 14

| RELATIVE SIZE MARKING-(mm × 10) FOR COMBINATION SAE-METRIC WRENCH OR SOCKET SETS | | |
|---|---|---|
| SAE (Distance Across Flats) (inches) | METRIC (Distance Across Flats) (mm) | PRESENT INVENTION |
| 5/32 | | 3.9 |
| | 4 | 4.0 |
| 3/16 | | 4.8 |
| | 5 | 5.0 |
| 7/32 | | 5.6 |
| | 6 | 6.0 |
| 1/4 | | 6.4 |
| | 7 | 7.0 |
| 9/32 | | 7.1 |
| 5/16 | | 7.9 |
| | 8 | 8.0 |
| | 9 | 9.0 |

CHART 14-continued

| RELATIVE SIZE MARKING-(mm × 10) FOR COMBINATION SAE-METRIC WRENCH OR SOCKET SETS | | |
|---|---|---|
| SAE (Distance Across Flats) (inches) | METRIC (Distance Across Flats) (mm) | PRESENT INVENTION |
| 3/8 | | 9.5 |
| | 10 | 10.0 |
| | 11 | 11.0 |
| 7/16 | | 11.1 |
| | 12 | 12.0 |
| 1/2 | | 12.7 |
| | 13 | 13.0 |
| | 14 | 14.0 |
| 9/16 | | 14.3 |
| | 15 | 15.0 |
| 5/8 | | 15.9 |
| | 16 | 16.0 |
| | 17 | 17.0 |
| 11/16 | | 17.5 |
| | 18 | 18.0 |
| | 19 | 19.0 |
| 3/4 | | 19.1 |
| | 20 | 20.0 |
| 13/16 | | 20.7 |
| | 21 | 21.0 |
| | 22 | 22.0 |
| 7/8 | | 22.2 |
| | 23 | 23.0 |
| 15/16 | | 23.8 |
| | 24 | 24.0 |
| | 25 | 25.0 |
| 1 | | 25.4 |
| | 26 | 26.0 |

Figure 15A:
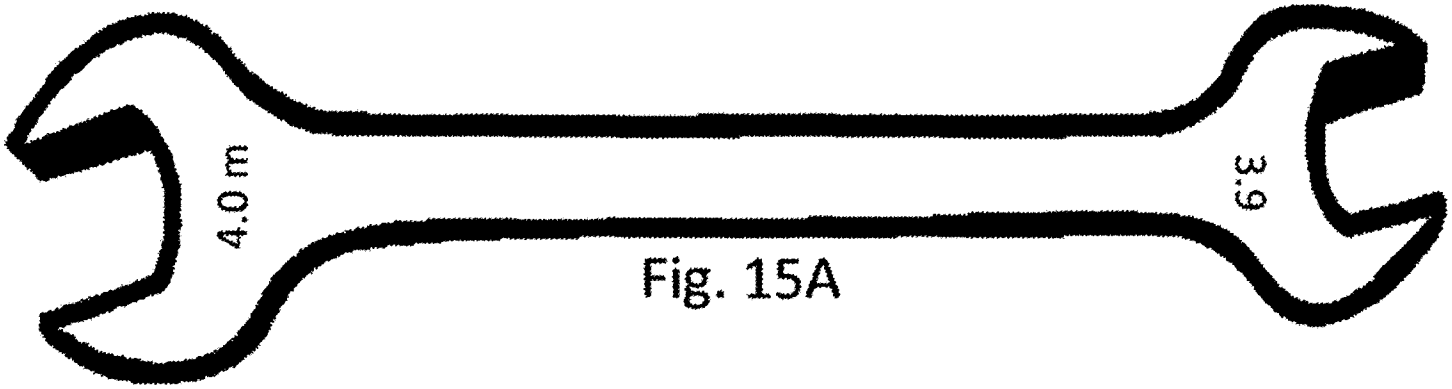
FIG. 15A is an illustration of one embodiment of the present invention.

Chart 15 illustrates one method of the present invention's unified marking system for SAE and metric standard tools. Chart 15 illustrates a relative size marking system that ranks SAE and metric tools from smallest to largest. Chart 15 also includes a letter "m" added to the sequential indicia to indicate whether the tool is sized for the metric system. The chart also illustrates the relative size markings in decimal millimeters. millimeter), One method of using the unified marking system indicia in Chart 15 is illustrated in FIG. 15A for a combination SAE-metric standard double open end wrench.

Figure 15B:
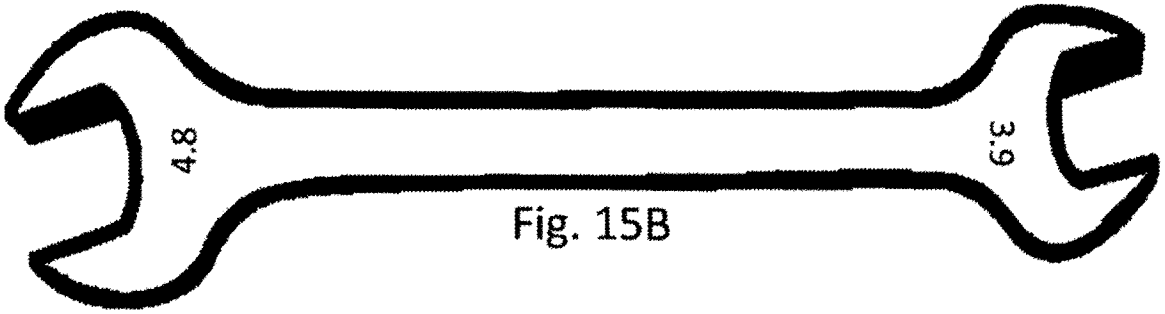
FIG. 15B is an illustration of one embodiment of the present invention.
Figure 15C:
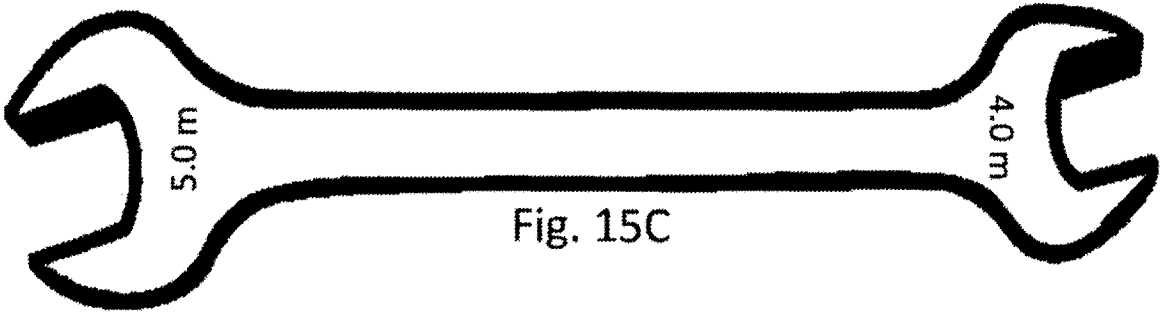
FIG. 15C is an illustration of one embodiment of the present invention.

FIGS. 15*b* and 15C illustrate the unified marking system indicia in Chart 15 for an SAE double open end wrench as illustrated in FIG. 15B, and for a metric standard double open end wrench as illustrated in FIG. 15C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 15

| RELATIVE SIZE MARKING-(mm × 10) FOR COMBINATION SAE-METRIC WRENCH OR SOCKET SETS | | |
|---|---|---|
| SAE (Distance Across Flats (inches) | METRIC (Distance Across Flats) (mm) | PRESENT INVENTION |
| 5/32 | | 3.9 |
| | 4 | 4.0 m |
| 3/16 | | 4.8 |
| | 5 | 5.0 m |
| 7/32 | | 5.6 |

CHART 15-continued

| RELATIVE SIZE MARKING-(mm × 10) FOR COMBINATION SAE-METRIC WRENCH OR SOCKET SETS | | |
|---|---|---|
| SAE (Distance Across Flats (inches) | METRIC (Distance Across Flats) (mm) | PRESENT INVENTION |
| | 6 | 60 m |
| 1/4 | | 6.4 |
| | 7 | 7.0 m |
| 9/32 | | 7.1 |
| 5/16 | | 7.9 |
| | 8 | 8.0 m |
| | 9 | 9.0 m |
| 3/8 | | 9.5 |
| | 10 | 10.0 m |
| | 11 | 11.0 m |
| 7/16 | | 11.1 |
| | 12 | 12.0 m |
| 1/2 | | 12.7 |
| | 13 | 13.0 m |
| | 14 | 14.0 m |
| 9/16 | | 14.3 |
| | 15 | 15.0 m |
| 5/8 | | 15.9 |
| | 16 | 16.0 m |
| | 17 | 17.0 |
| 11/16 | | 17.5 |
| | 18 | 18.0 m |
| | 19 | 19.0 m |
| 3/4 | | 19.1 |
| | 20 | 20.0 m |
| 13/16 | | 20.7 |
| | 21 | 21.0 m |
| | 22 | 22.0 m |
| 7/8 | | 22.2 m |
| | 23 | 23.0 m |
| 15/16 | | 23.8 |
| | 24 | 24.0 m |
| | 25 | 25.0 m |
| 1 | | 25.4 m |
| | 26 | 26.0 m |

Chart 16 illustrates one method of the present invention's unified marking system for SAE and metric standard tools. Chart 16 illustrates a relative size marking system that ranks SAE and metric tools from smallest to largest. The chart also illustrates the relative size markings in decimal millimeters. Chart 16 also includes a two color code to indicate whether the tool is sized for the SAE or metric system. As an example in FIGS. 16B and 16C, the color green indicates the tool is sized for SAE, and the color red indicates the tool is sized for metric.

Figure 16A:
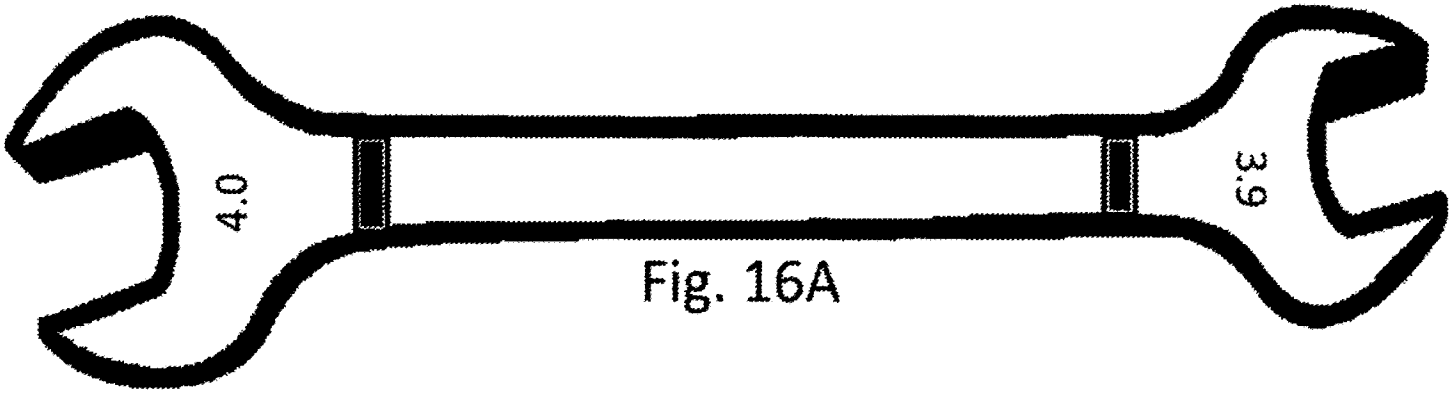
FIG. 16A is an illustration of one embodiment of the present invention.

One method of using the unified marking system indicia in Chart 16 is illustrated in FIG. 16A for a combination SAE-metric standard double open end wrench.

Figure 16B:
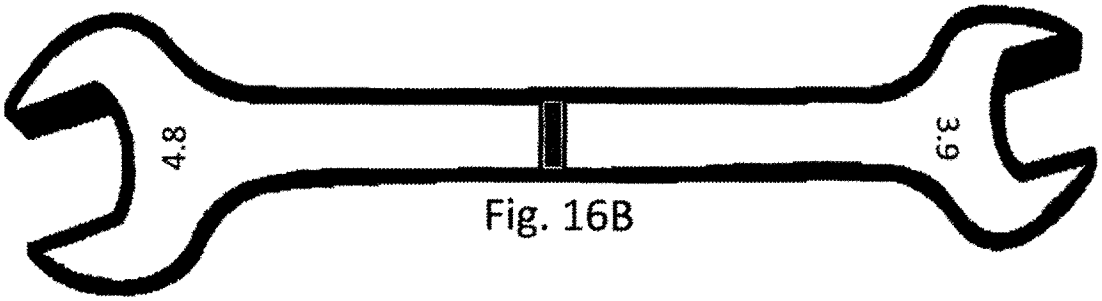
FIG. 16B is an illustration of one embodiment of the present invention.
Figure 16C:
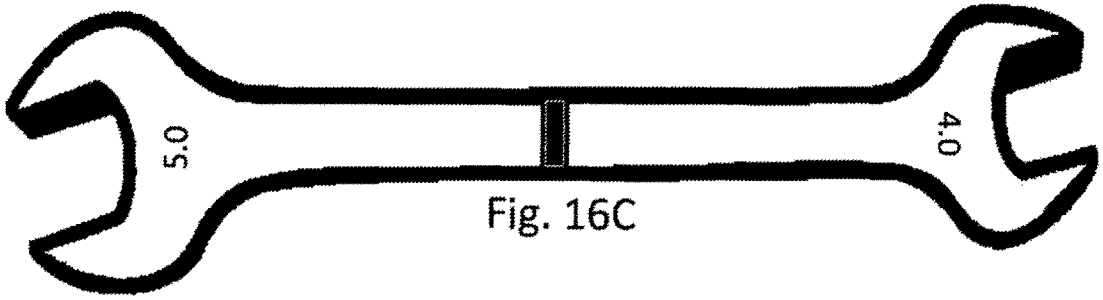
FIG. 16C is an illustration of one embodiment of the present invention.

FIGS. 16B and 16C illustrate the unified marking system indicia in Chart 16 for an SAE double open end wrench as illustrated in FIG. 16B, and for a metric standard double open end wrench as illustrated in FIG. 16C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 16

RELATIVE SIZE MARKING-(mm × 10) FOR COMBINATION SAE-METRIC WRENCH OR SOCKET SETS

| SAE (Distance Across Flats) (inches) | METRIC (Distance Across Flats) (mm) | PRESESNT INVENTION | PRESENT INVENTION (Wrench Color Marking) |
|---|---|---|---|
| 5/32 | | 3.9 | Color A |
| | 4 | 4.0 | Color B |
| 3/16 | | 4.8 | Color A |
| | 5 | 5.0 | Color B |
| 7/32 | | 5.6 | Color A |
| | 6 | 6.0 | Color B |
| 1/4 | | 6.4 | Color A |
| | 7 | 7.0 | Color B |
| 9/32 | | 7.1 | Color A |
| 5/16 | | 7.9 | Color A |
| | 8 | 8.0 | Color B |
| | 9 | 9.0 | Color B |
| 3/8 | | 9.5 | Color A |
| | 10 | 10.0 | Color B |
| | 11 | 11.0 | Color B |
| 7/16 | | 11.1 | Color A |
| | 12 | 12.0 | Color B |
| 1/2 | | 12.7 | Color A |
| | 13 | 13.0 | Color B |
| | 14 | 14.0 | Color B |
| 9/16 | | 14.3 | Color A |
| | 15 | 15.0 | Color B |
| 5/8 | | 15.9 | Color A |
| | 16 | 16.0 | Color B |
| | 17 | 17.0 | Color B |
| 11/16 | | 17.5 | Color A |
| | 18 | 18.0 | Color B |
| | 19 | 19.0 | Color B |
| 3/4 | | 19.1 | Color A |
| | 20 | 20.0 | Color B |
| 13/16 | | 20.7 | Color A |
| | 21 | 21.0 | Color B |
| | 22 | 22.0 | Color B |
| 7/8 | | 22.2 | Color A |
| | 23 | 23.0 | Color B |
| 15/16 | | 23.8 | Color A |
| | 24 | 24.0 | Color B |
| | 25 | 25.0 | Color B |
| 1 | | 25.4 | Color A |
| | 26 | 26.0 | Color B |

Chart 17 illustrates one method of the present invention's unified marking system for SAE and metric standard tools. Chart 17 illustrates a relative size marking system that ranks SAE and metric tools from smallest to largest. Chart 17 also includes a two color code to indicate whether the tool is sized for the SAE or metric system. As an example in FIGS. 17B and 17C, the color green indicates the tool is sized for SAE, and the color red indicates the tool is sized for metric. Chart 17 also includes a letter "m" added to the sequential indicia to further indicate whether the tool is sized for the metric system. The chart also illustrates the relative size markings in decimal millimeters.

Figure 17A:
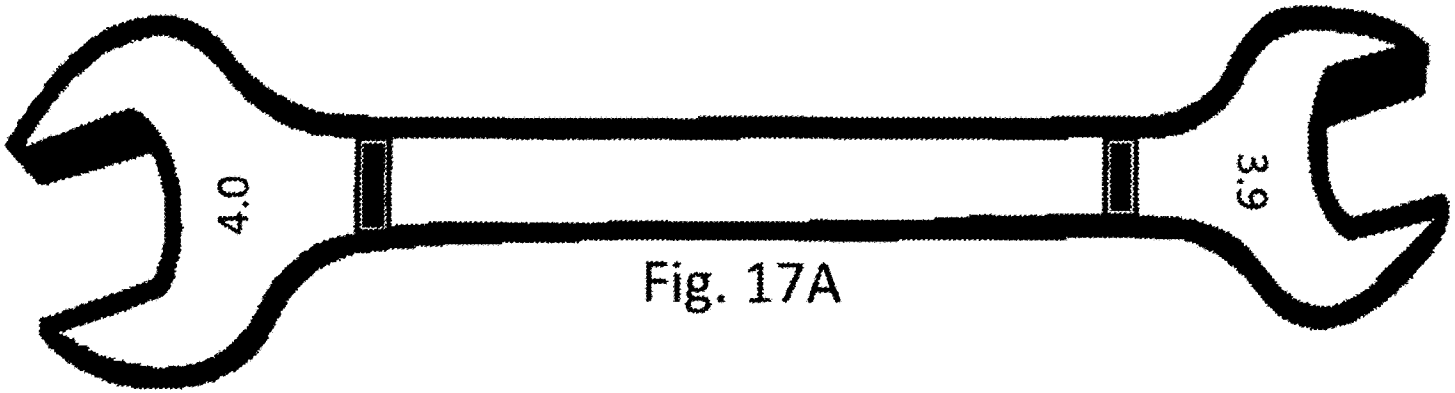
FIG. 17A is an illustration of one embodiment of the present invention.

One method of using the unified marking system indicia in Chart 17 is illustrated in FIG. 17A for a combination SAE-metric standard double open end wrench.

Figure 17B:
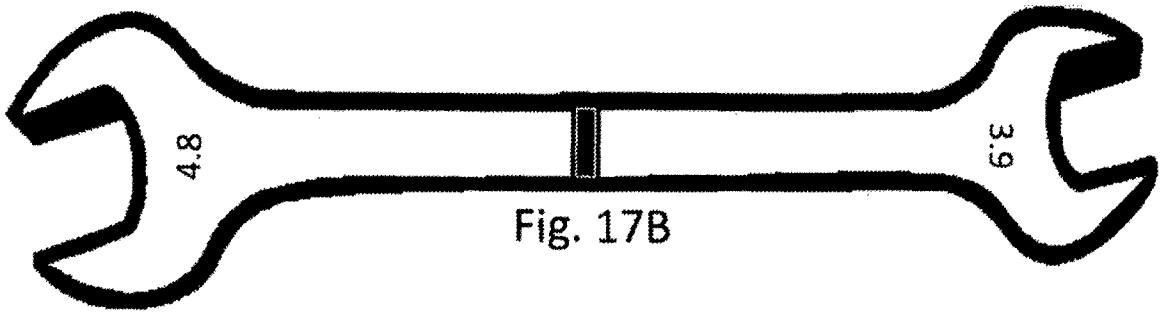
FIG. 17B is an illustration of one embodiment of the present invention.
Figure 17C:
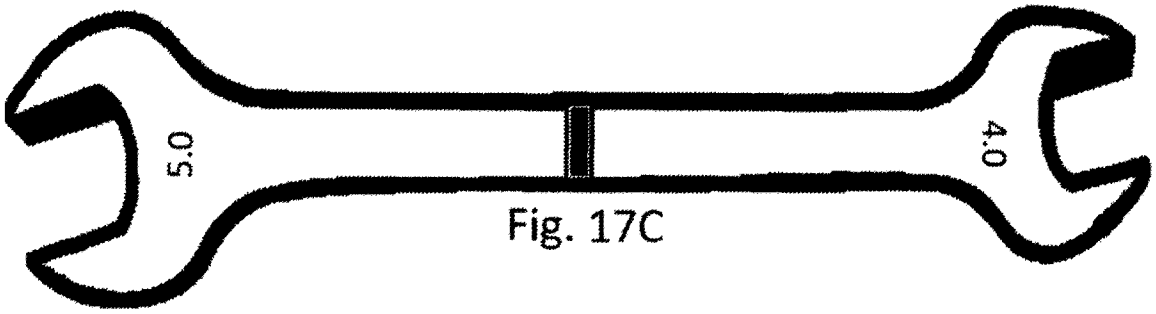
FIG. 17C is an illustration of one embodiment of the present invention.

FIGS. 17B and 17C illustrate the unified marking system indicia in Chart 17 for an SAE double open end wrench as illustrated in FIG. 17B, and for a metric standard double open end wrench as illustrated in FIG. 17C.

A user working on a machine, object, etc, could easily conclude which wrench, is the nearest size up or down, from the wrench they incorrectly chose when trying to size the right wrench to a fastener, regardless of whether the fastener is sized according to an SAE or metric standard.

CHART 17

RELATIVE SIZE MARKING-(mm × 10) FOR COMBINATION SAE-METRIC WRENCH OR SOCKET SETS

| SAE (Distance Across Flats) (inches) | METRIC (Distance Across Flats) (mm) | PRESESNT INVENTION (Alternative Marking Relative Size-mm × 10, Where "m" Indicates Metric) | PRESENT INVENTION (Wrench Color Marking) |
|---|---|---|---|
| 5/32 | | 3.9 | Color A |
| | 4 | 4.0 m | Color B |
| 3/16 | | 4.8 | Color A |
| | 5 | 5.0 m | Color B |
| 7/32 | | 5.6 | Color A |
| | 6 | 6.0 m | Color B |
| 1/4 | | 6.4 | Color A |
| | 7 | 7.0 m | Color B |
| 9/32 | | 7.1 | Color A |
| 5/16 | | 7.9 | Color A |
| | 8 | 8.0 m | Color B |
| | 9 | 9.0 m | Color B |
| 3/8 | | 9.5 | Color A |
| | 10 | 10.0 m | Color B |
| | 11 | 11.0 m | Color B |
| 7/16 | | 11.1 | Color A |
| | 12 | 12.0 m | Color B |
| 1/2 | | 12.7 | Color A |
| | 13 | 13.0 m | Color B |
| | 14 | 14.0 m | Color B |
| 9/16 | | 14.3 | Color A |
| | 15 | 15.0 m | Color B |
| 5/8 | | 15.9 | Color A |
| | 16 | 16.0 m | Color B |
| | 17 | 17.0 m | Color B |
| 11/16 | | 17.5 | Color A |
| | 18 | 18.0 m | Color B |
| | 19 | 19.0 m | Color B |
| 3/4 | | 19.1 | Color A |
| | 20 | 20.0 m | Color B |
| 13/16 | | 20.7 | Color A |
| | 21 | 21.0 m | Color B |
| | 22 | 22.0 m | Color B |
| 7/8 | | 22.2 | Color A |
| | 23 | 23.0 m | Color B |
| 15/16 | | 23.8 | Color A |
| | 24 | 24.0 m | Color B |
| | 25 | 25.0 m | Color B |
| 1 | | 25.4 | Color A |
| | 26 | 26.0 m | Color B |

Each of the FIGS. 1A through 17C can have texture added to the tool as a further aid in distinguishing between tools manufactured according to different standards. The texture may be achieved by a process such as, but not limited to, knurling.

The present invention's unified marking system can be applied to tools such as, but not limited to, open end wrenches, box end wrenches, combination open end-box end wrenches, wrenches with a socket on one end, sockets, wrenches which include a SAE standard tool on one end, and a metric standard tool on the other end, offset wrenches, adjustable end wrenches to indicate the range of the jaws, pipe wrenches to indicate the range of the jaws, monkey wrenches to indicate the range of the jaws, ratcheting box wrenches, vise grips to indicate the range of the jaws, nut drivers, wrenches for use with internal sockets, etc.

The present invention can also be used as a unified marking system to mark 10 fasteners, fastener bins, etc.

The present invention for a unified marking system can be used in conjunction with RFID tags that are embedded, or attached to a tool, fastener, etc.

The present invention for a unified marking system can be used in conjunction with bar code tags that are attached to a tool, fastener, etc.

These RFID tags and bar codes can be created according to EPCglobal standard for identification for RFID, or bar codes.

The present invention may be applied during the manufacturing process as part of an operation, such as, but not limited to, forging, or pressing.

The present invention may be applied after the manufacturing process as part of an operation, such as, but not limited to, stamping, or engraving.

The present invention may be applied to a measurement device, such as a caliper with a digital readout, or a linear scale on a device such as, but not limited to, a ruler, the side of a wrench, etc.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to a particular embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A system for marking a set of hand tools marked according to a unified system, the set of hand tools comprising a first subset of the set of hand tools comprising a first plurality of the hand tools, each of the hand tools within the first subset having a metric size indicator thereon and a second subset of the set of hand tools comprising a second plurality of the hand tools, each of the hand tools within the second subset having a standard size indicator thereon, the system comprising:

sequential relative size marking for each of the hand tools within the set to identify a size of each of the hand tools from smallest to largest within the set and independent of whether the hand tool has a metric size indicator thereon or a standard size indicator thereon;

wherein the sequential relative size marking consist of at least one of letters and numbers; and a chart on a physical medium containing the relative size markings for each of the hand tools and the metric size indicator or the standard size indicator for each of the hand tools.

2. The system of claim 1 wherein the metric size indicator is expressed in millimeters.

3. The system of claim 1 wherein the standard size indicator is expressed in inches.

4. The system of claim 1 wherein each of the hand tools is a wrench.

5. The system of claim 1 wherein each of the hand tools within the first subset has a first color marking and wherein each of the hand tools within the second subset has a second color marking, the first color marking differing from the second color marking.

6. The set of hand tools of claim 5 wherein:

the first subset of the set of hand tools includes a first metric size hand tool and a second metric size hand tool;

the second subset of the set of hand tools includes a first standard size hand tool and a second standard size hand tool; and the sequential relative size markings identify that the first metric size hand tool is bigger than the first standard size hand tool, the first standard size hand tool is bigger than the second metric size hand tool, and the second metric size hand tool is bigger than the second standard size hand tool.

7. A system comprising:

a set of hand tools marked according to a unified system, the set comprising:

(a) a first subset of the set of hand tools comprising a first plurality of the hand tools, each of the hand tools within the first subset having a metric size and a metric size indicator thereon, the metric size indicator indicating the metric size;

(b) a second subset of the set of hand tools comprising a second plurality of the hand tools, each of the hand tools within the second subset having a standard size and a standard size indicator thereon, the standard size indicator indicating the standard size; and (c) sequential relative size marking on each of the hand tools within the set to identify a size of each of the hand tools from smallest to largest within the set and independent of whether the hand tool has a metric size indicator thereon or a standard size indicator thereon;

(d) wherein each of the sequential relative size markings is not a metric size indicator;

(e) wherein each of the sequential relative size markings is not a standard size indicator;

(f) wherein the sequential relative size marking consists of at least one of letters and numbers; and a chart on a physical medium containing the relative size markings for each of the hand tools and the metric size indicator or the standard size indicator for each of the hand tools.

8. A system comprising:

a set of hand tools marked according to a unified system, the set comprising:

(a) a first subset of the set of hand tools comprising a first plurality of the hand tools, each of the hand tools within the first subset having a metric size indicator thereon;

(b) a second subset of the set of hand tools comprising a second plurality of the hand tools, each of the hand tools within the second subset having a standard size indicator thereon; and (c) sequential relative size marking one each of the hand tools within the set to identify a size of each of the hand tools from smallest to largest within the set and independent of whether the hand tool has a metric size indicator thereon or a standard size indicator thereon;

(d) wherein the sequential relative size marking consist of at least one of letters and numbers;

a chart on a physical medium containing the relative size markings for each of the hand tools and the metric size indicator or the standard size indicator for each of the hand tools.

9. The set of hand tools of claim 8 wherein the metric size indicator is expressed in millimeters.

10. The set of hand tools of claim 8 wherein the standard size indicator is expressed in inches.

11. The set of hand tools of claim 8 wherein each of the hand tools in a wrench.

12. The set of hand tools of claim 8 wherein each of the hand tools within the first subset has a first color marking and wherein each of the hand tools within the second subset has a second color marking, the first color marking differing from the second color marking.

13. The set of hand tools of claim 8 wherein:

the first subset of the set of hand tools includes a first metric size hand tool and a second metric size hand tool;

the second subset of the set of hand tools includes a first standard size hand tool and a second standard size hand tool; and the sequential relative size markings identify that the first metric size hand tool is bigger than the first standard size hand tool, the first standard size hand tool is bigger than the second metric size hand tool, and the second metric size hand tool is bigger than the second standard size hand tool.

* * * * *